US007962274B2

(12) United States Patent
Yonezawa et al.

(10) Patent No.: US 7,962,274 B2
(45) Date of Patent: Jun. 14, 2011

(54) VEHICLE-MOUNTED ENGINE CONTROL APPARATUS

(75) Inventors: Shiro Yonezawa, Chiyoda-ku (JP); Koji Hashimoto, Chiyoda-ku (JP); Shoso Tsunekazu, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 702 days.

(21) Appl. No.: 12/059,829

(22) Filed: Mar. 31, 2008

(65) Prior Publication Data

US 2009/0030587 A1 Jan. 29, 2009

(30) Foreign Application Priority Data

Jul. 27, 2007 (JP) ..... 2007-196060

(51) Int. Cl.
*F02D 45/00* (2006.01)

(52) U.S. Cl. ..... 701/103; 701/114; 701/115

(58) Field of Classification Search ..... 701/101–105, 701/110, 112–115; 123/458, 496, 497; 73/114.22–114.25, 114.41, 114.45, 114.49, 73/114.63

See application file for complete search history.

(56) References Cited

U.S. PATENT DOCUMENTS

| | | | | |
|---|---|---|---|---|
| 4,580,221 | A * | 4/1986 | Isobe et al. | 701/105 |
| 4,768,013 | A * | 8/1988 | Aramaki | 340/438 |
| 6,285,931 | B1 * | 9/2001 | Hattori et al. | 701/29 |
| 6,415,210 | B2 * | 7/2002 | Hozuka et al. | 701/29 |
| 6,775,609 | B2 * | 8/2004 | Ozeki et al. | 701/114 |
| 6,805,094 | B2 * | 10/2004 | Hashimoto et al. | 123/396 |
| 6,810,860 | B2 * | 11/2004 | Tani et al. | 123/491 |
| 7,010,419 | B2 * | 3/2006 | Abe et al. | 701/111 |
| 7,263,431 | B2 * | 8/2007 | Hashimoto et al. | 701/111 |
| 7,369,926 | B2 * | 5/2008 | Hashimoto et al. | 701/36 |
| 2001/0037168 | A1 * | 11/2001 | Hozuka et al. | 701/29 |

FOREIGN PATENT DOCUMENTS

| | | | |
|---|---|---|---|
| JP | 58197556 | A | 11/1983 |
| JP | 62237536 | A | 10/1987 |
| JP | 63109545 | A | 5/1988 |
| JP | 03141836 | A | 6/1991 |
| JP | 05079373 | A | 3/1993 |
| JP | 06214831 | A | 8/1994 |
| JP | 2002235598 | A | 8/2002 |
| JP | 2003-097345 | A | 4/2003 |
| JP | 2003-155945 | A | 5/2003 |
| JP | 2003343326 | A | 12/2003 |
| JP | 2004-027976 | A | 1/2004 |
| JP | 2005031993 | A | 2/2005 |
| JP | 2006-150999 | A | 6/2006 |
| WO | 9732123 | A1 | 9/1997 |

* cited by examiner

*Primary Examiner* — Stephen K Cronin
*Assistant Examiner* — Johnny H Hoang
(74) *Attorney, Agent, or Firm* — Sughrue Mion, PLLC

(57) ABSTRACT

In an vehicle-mounted engine control apparatus according to the present invention, a restart inspection mechanism, which is simpler than an activation inspection mechanism, is provided, and the mechanism to be applied is selected by an initialization determination device. The contents of the restart inspection are limited to malfunction items detected by a periodic code inspector during driving of the vehicle. As a result, the time required to restart a microprocessor when a malfunction occurs is shortened.

14 Claims, 12 Drawing Sheets

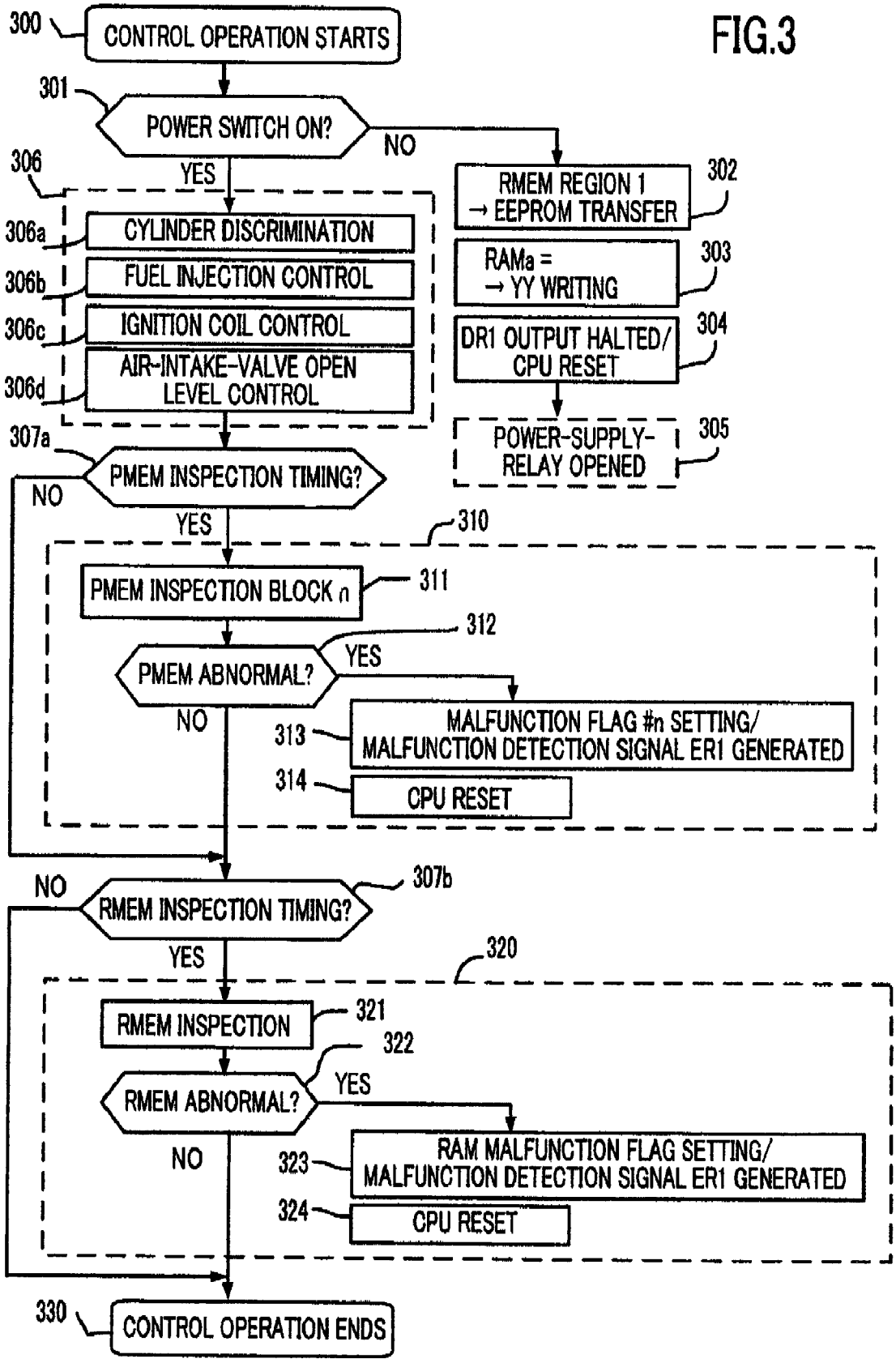
FIG.3
300
CONTROL OPERATION STARTS
301
POWER SWITCH ON?
NO
YES
302
RMEM REGION 1 → EEPROM TRANSFER
303
RAMa = → YY WRITING
304
DR1 OUTPUT HALTED/ CPU RESET
305
POWER-SUPPLY-RELAY OPENED
306
306a
CYLINDER DISCRIMINATION
306b
FUEL INJECTION CONTROL
306c
IGNITION COIL CONTROL
306d
AIR-INTAKE-VALVE OPEN LEVEL CONTROL
307a
PMEM INSPECTION TIMING?
NO
YES
310
PMEM INSPECTION BLOCK n
311
312
PMEM ABNORMAL?
YES
NO
313
MALFUNCTION FLAG #n SETTING/ MALFUNCTION DETECTION SIGNAL ER1 GENERATED
314
CPU RESET
NO
RMEM INSPECTION TIMING?
307b
YES
320
RMEM INSPECTION
321
322
RMEM ABNORMAL?
YES
NO
323
RAM MALFUNCTION FLAG SETTING/ MALFUNCTION DETECTION SIGNAL ER1 GENERATED
324
CPU RESET
330
CONTROL OPERATION ENDS

FIG.5

CYLINDER DISCRIMINATION STARTS

PORT-INJECTION

| | STROKE 1 | STROKE 2 | STROKE 3 | STROKE 4 | STROKE 5 | STROKE 6 | STROKE 7 | STROKE 8 |
|---|---|---|---|---|---|---|---|---|

(A) SYNCHRONOUS INJECTION — INITIAL COMBUSTION = FIFTH STROKE

| | | | | | | | | | |
|---|---|---|---|---|---|---|---|---|---|
| CYLINDER 1 | AIR INTAKE | COMPRESSION | COMBUSTION | DISCHARGE 53a→ I | AIR INTAKE | COMPRESSION IG | COMBUSTION 56 | DISCHARGE I | AIR INTAKE |
| CYLINDER 3 | DISCHARGE | AIR INTAKE | COMPRESSION | COMBUSTION | DISCHARGE 54c→ I | AIR INTAKE | COMPRESSION IG | COMBUSTION 57 | DISCHARGE I |
| CYLINDER 4 | COMBUSTION | DISCHARGE | AIR INTAKE | COMPRESSION IG | COMBUSTION | DISCHARGE I | AIR INTAKE | COMPRESSION IG | COMBUSTION 58 |
| CYLINDER 2 | COMPRESSION | COMBUSTION | DISCHARGE 52b→ I | AIR INTAKE | COMPRESSION IG | COMBUSTION 55 | DISCHARGE I | AIR INTAKE | COMPRESSION IG |

(B) SECOND ASYNCHRONOUS INJECTION — INITIAL COMBUSTION = FOURTH STROKE

| | | | | | | | | | |
|---|---|---|---|---|---|---|---|---|---|
| CYLINDER 1 | AIR INTAKE | COMPRESSION 51a→ I | COMBUSTION | DISCHARGE 53a→ I | AIR INTAKE | COMPRESSION IG | COMBUSTION 56 | DISCHARGE I | AIR INTAKE |
| CYLINDER 3 | DISCHARGE | AIR INTAKE | COMPRESSION | COMBUSTION | DISCHARGE 54c→ I | AIR INTAKE | COMPRESSION IG | COMBUSTION 57 | DISCHARGE I |
| CYLINDER 4 | COMBUSTION | DISCHARGE 51d→ I | AIR INTAKE | COMPRESSION IG | COMBUSTION 54 | DISCHARGE I | AIR INTAKE | COMPRESSION IG | COMBUSTION 58 |
| CYLINDER 2 | COMPRESSION | COMBUSTION | DISCHARGE 52b→ I | AIR INTAKE | COMPRESSION IG | COMBUSTION 55 | DISCHARGE I | AIR INTAKE | COMPRESSION IG |

(C) FIRST ASYNCHRONOUS INJECTION (LATE-STAGE INJECTION) — INITIAL COMBUSTION = THIRD STROKE

| | | | | | | | | | |
|---|---|---|---|---|---|---|---|---|---|
| CYLINDER 1 | AIR INTAKE | COMPRESSION 51a→ I | COMBUSTION | DISCHARGE 53a→ I | AIR INTAKE | COMPRESSION IG | COMBUSTION 56 | DISCHARGE I | AIR INTAKE |
| CYLINDER 3 | DISCHARGE | AIR INTAKE 51c→ I | COMPRESSION IG | COMBUSTION 53 | DISCHARGE 54c→ I | AIR INTAKE | COMPRESSION IG | COMBUSTION 57 | DISCHARGE I |
| CYLINDER 4 | COMBUSTION | DISCHARGE 51d→ I | AIR INTAKE | COMPRESSION IG | COMBUSTION 54 | DISCHARGE I | AIR INTAKE | COMPRESSION IG | COMBUSTION 58 |
| CYLINDER 2 | COMPRESSION | COMBUSTION 51b→ I | DISCHARGE 52b→ I | AIR INTAKE | COMPRESSION IG | COMBUSTION 55 | DISCHARGE I | AIR INTAKE | COMPRESSION IG |

FIG.6

CYLINDER DISCRIMINATION STARTS

DIRECT-INJECTION (A) SYNCHRONOUS INJECTION — INITIAL COMBUSTION = FOURTH STROKE

| | STROKE 1 | STROKE 2 | STROKE 3 | STROKE 4 | STROKE 5 | STROKE 6 | STROKE 7 | STROKE 8 |
|---|---|---|---|---|---|---|---|---|
| CYLINDER 1 | AIR INTAKE | COMPRESSION | COMBUSTION | DISCHARGE | AIR INTAKE I | COMPRESSION IG | COMBUSTION 66 | DISCHARGE | AIR INTAKE I |
| CYLINDER 3 | DISCHARGE | AIR INTAKE | COMPRESSION | COMBUSTION | DISCHARGE | AIR INTAKE I | COMPRESSION IG | COMBUSTION 67 | DISCHARGE |
| CYLINDER 4 | COMBUSTION | DISCHARGE | AIR INTAKE 62d→ I | COMPRESSION IG | COMBUSTION 64 | DISCHARGE | AIR INTAKE I | COMPRESSION IG | COMBUSTION 68 |
| CYLINDER 2 | COMPRESSION | COMBUSTION | DISCHARGE | AIR INTAKE 63b→ I | COMPRESSION IG | COMBUSTION 65 | DISCHARGE | AIR INTAKE I | COMPRESSION IG |

(B) SECOND ASYNCHRONOUS INJECTION — INITIAL COMBUSTION = THIRD STROKE

| | STROKE 1 | STROKE 2 | STROKE 3 | STROKE 4 | STROKE 5 | STROKE 6 | STROKE 7 | STROKE 8 |
|---|---|---|---|---|---|---|---|---|
| CYLINDER 1 | AIR INTAKE | COMPRESSION | COMBUSTION | DISCHARGE | AIR INTAKE I | COMPRESSION IG | COMBUSTION 66 | DISCHARGE | AIR INTAKE I |
| CYLINDER 3 | DISCHARGE | AIR INTAKE 61c→ I | COMPRESSION IG | COMBUSTION 63 | DISCHARGE | AIR INTAKE I | COMPRESSION IG | COMBUSTION 67 | DISCHARGE |
| CYLINDER 4 | COMBUSTION | DISCHARGE | AIR INTAKE 62d→ I | COMPRESSION IG | COMBUSTION 64 | DISCHARGE | AIR INTAKE I | COMPRESSION IG | COMBUSTION 68 |
| CYLINDER 2 | COMPRESSION | COMBUSTION 61b→ I | DISCHARGE | AIR INTAKE 63b→ I | COMPRESSION IG | COMBUSTION 65 | DISCHARGE | AIR INTAKE I | COMPRESSION IG |

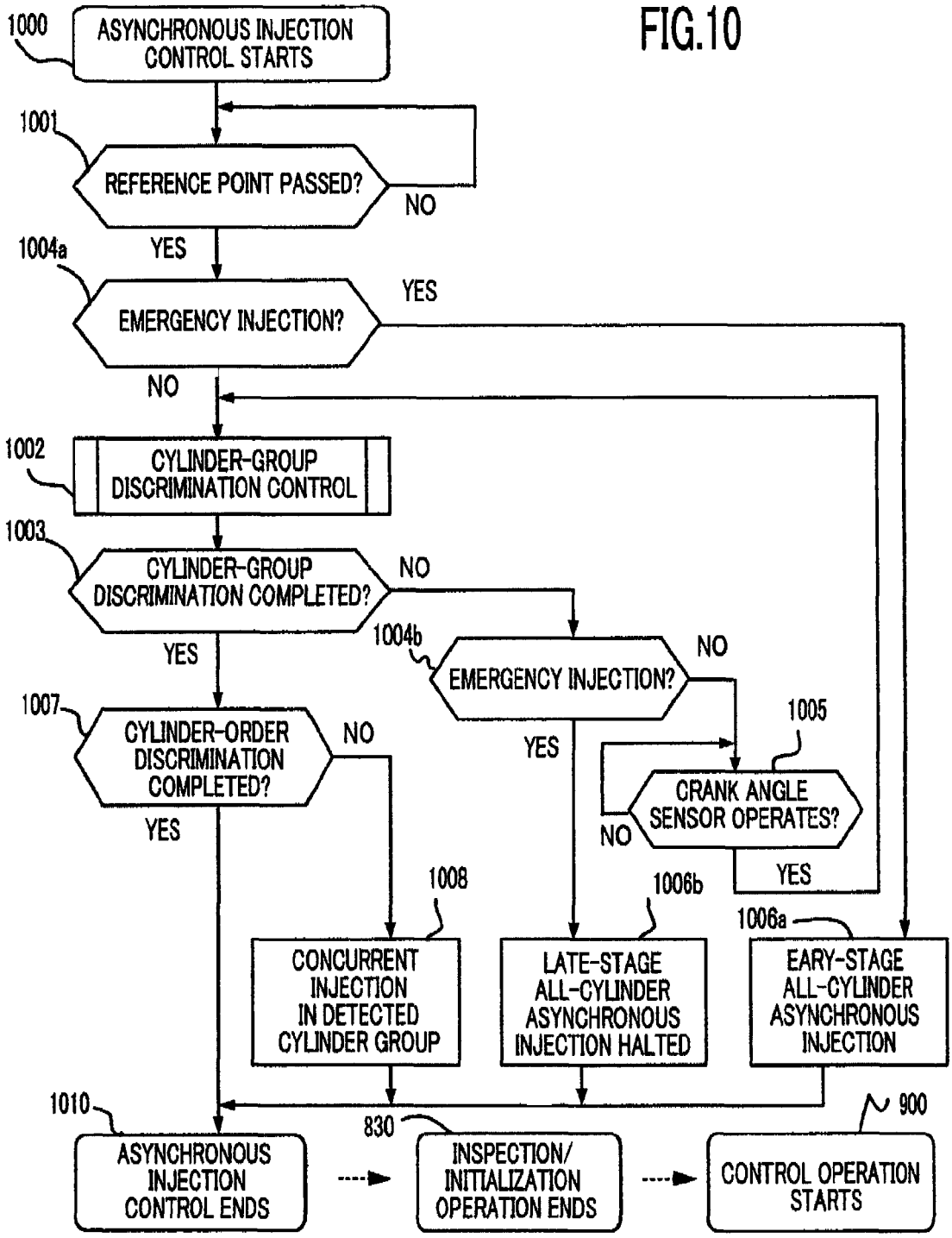
FIG.10
1000
ASYNCHRONOUS INJECTION CONTROL STARTS
1001
REFERENCE POINT PASSED?
NO
YES
1004a
EMERGENCY INJECTION?
YES
NO
1002
CYLINDER-GROUP DISCRIMINATION CONTROL
1003
CYLINDER-GROUP DISCRIMINATION COMPLETED?
NO
YES
1004b
EMERGENCY INJECTION?
NO
YES
1007
CYLINDER-ORDER DISCRIMINATION COMPLETED?
NO
YES
1005
CRANK ANGLE SENSOR OPERATES?
NO
YES
1008
CONCURRENT INJECTION IN DETECTED CYLINDER GROUP
1006b
LATE-STAGE ALL-CYLINDER ASYNCHRONOUS INJECTION HALTED
1006a
EARY-STAGE ALL-CYLINDER ASYNCHRONOUS INJECTION
1010
ASYNCHRONOUS INJECTION CONTROL ENDS
830
INSPECTION/ INITIALIZATION OPERATION ENDS
900
CONTROL OPERATION STARTS

FIG.11

PORT-INJECTION

CYLINDER DISCRIMINATION STARTS

| | STROKE 1 | STROKE 2 | STROKE 3 | STROKE 4 | STROKE 5 | STROKE 6 | STROKE 7 | STROKE 8 |
|---|---|---|---|---|---|---|---|---|

(A) SYNCHRONOUS INJECTION — INITIAL COMBUSTION = FIFTH STROKE

| | | | | | | | | | |
|---|---|---|---|---|---|---|---|---|---|
| CYLINDER 1 | AIR INTAKE | COMPRESSION | COMBUSTION | DISCHARGE 53a→ I | AIR INTAKE | COMPRESSION IG | COMBUSTION 56 | DISCHARGE I | AIR INTAKE |
| CYLINDER 3 | DISCHARGE | AIR INTAKE | COMPRESSION | COMBUSTION | DISCHARGE 54c→ I | AIR INTAKE | COMPRESSION IG | COMBUSTION 57 | DISCHARGE I |
| CYLINDER 4 | COMBUSTION | DISCHARGE | AIR INTAKE | COMPRESSION IG | COMBUSTION | DISCHARGE I | AIR INTAKE | COMPRESSION IG | COMBUSTION 58 |
| CYLINDER 2 | COMPRESSION | COMBUSTION | DISCHARGE 52b→ I | AIR INTAKE | COMPRESSION IG | COMBUSTION 55 | DISCHARGE I | AIR INTAKE | COMPRESSION IG |

(B) SECOND ASYNCHRONOUS INJECTION — INITIAL COMBUSTION = FOURTH STROKE

| | | | | | | | | | |
|---|---|---|---|---|---|---|---|---|---|
| CYLINDER 1 | AIR INTAKE | COMPRESSION 51a→ I | COMBUSTION | DISCHARGE 53a→ I | AIR INTAKE | COMPRESSION IG | COMBUSTION 56 | DISCHARGE I | AIR INTAKE |
| CYLINDER 3 | DISCHARGE | AIR INTAKE | COMPRESSION | COMBUSTION | DISCHARGE 54c→ I | AIR INTAKE | COMPRESSION IG | COMBUSTION 57 | DISCHARGE I |
| CYLINDER 4 | COMBUSTION | DISCHARGE 51d→ I | AIR INTAKE | COMPRESSION IG | COMBUSTION 54 | DISCHARGE I | AIR INTAKE | COMPRESSION IG | COMBUSTION 58 |
| CYLINDER 2 | COMPRESSION | COMBUSTION | DISCHARGE 52b→ I | AIR INTAKE | COMPRESSION IG | COMBUSTION 55 | DISCHARGE I | AIR INTAKE | COMPRESSION IG |

(C) FIRST ASYNCHRONOUS INJECTION (EARLY-STAGE INJECTION) — INITIAL COMBUSTION = THIRD STROKE

| | | | | | | | | | |
|---|---|---|---|---|---|---|---|---|---|
| CYLINDER 1 | AIR INTAKE 50a→ I | COMPRESSION | COMBUSTION | DISCHARGE 53a→ I | AIR INTAKE | COMPRESSION IG | COMBUSTION 56 | DISCHARGE I | AIR INTAKE |
| CYLINDER 3 | DISCHARGE 50c→ I | AIR INTAKE | COMPRESSION IG | COMBUSTION 53 | DISCHARGE 54c→ I | AIR INTAKE | COMPRESSION IG | COMBUSTION 57 | DISCHARGE I |
| CYLINDER 4 | COMBUSTION 50d→ I | DISCHARGE | AIR INTAKE | COMPRESSION IG | COMBUSTION 54 | DISCHARGE I | AIR INTAKE | COMPRESSION IG | COMBUSTION 58 |
| CYLINDER 2 | COMPRESSION 50b→ I | COMBUSTION | DISCHARGE 52b→ I | AIR INTAKE | COMPRESSION IG | COMBUSTION 55 | DISCHARGE I | AIR INTAKE | COMPRESSION IG |

1200
RAM-INITIAL-SETTING OPERATION STARTS
1201
RESTART?
YES
RESTART
NO
1202
ALL POWER SOURCE INTERRUPTED/ RAMb ≠ YY?
NO
YES
1203
PROGRAM MEMORY → WRITING IN RAM2
1204
DATA MEMORY → WRITING IN RAM1
1205
RAM REGION 3 RESET
1206
FIRST REGION?
NO
YES
1207
DATA MEMORY → WRITING IN RAM1 ABNORMAL ADDRESS
1208
SECOND REGION?
NO
YES
1209
PROGRAM MEMORY → WRITING IN RAM2 ABNORMAL ADDRESS
1210
RAM-INITIAL-SETTING OPERATION ENDS

VEHICLE-MOUNTED ENGINE CONTROL APPARATUS

BACKGROUND OF THE INVENTION

1. Field of the Invention

The present invention relates to an vehicle-mounted engine control apparatus provided with an improved microprocessor-initialization means that resets a microprocessor in response to the occurrence of a contingent malfunction, e.g., due to an erroneous operation caused by noise, rapidly performs inspection and initialization, and then restart the microprocessor.

2. Description of the Related Art

In general, in the case where, when a microprocessor malfunction occurs while the engine is running, the microprocessor is reset and then restarted after the inspection of related units, it is required to spend enough time so as to perform a sufficient inspection in consideration of the safety; however, there exists a contradictory demand that the engine interruption time is shortened as much as possible. For example, Patent Document 1 (Japanese Patent Application Laid-Open No. 2006-150999) discloses a technology in which applications are divided into a first type application corresponding to a control means that are required to preferentially function upon the activation of a control apparatus and a second type application corresponding to the other control means, and when the control apparatus is activated, the resource setting is performed only for the first type application having higher priority, and the resource setting for the second type application having lower priority is performed after the activation of the first application; a vehicle control apparatus has been provided in which, in the case where an ECU (electronic control unit), which is a main control device for hardware that implements a plurality of applications, is reset and then restarted, the operation interruption time, of specific important functions, due to the restarting processing can be shortened, and eventually, user's sense of discomfort or sense of displeasure due to the functional interruption can be reduced.

In addition, Patent Document 2 (Japanese Patent Application Laid-Open No. 2003-97345) discloses a vehicle electronic control apparatus that includes a CPU (microprocessor) for implementing the control of engine injection, ignition, and throttle and a WD (watchdog timer) circuit for monitoring the operation of the CPU, and in which the WD circuit outputs a reset signal to the CPU in the case where a WD pulse from the CPU does not reverse in a time the same as or longer than a predetermined time, a storage unit formed of a flip-flop, a counter, or the like is provided in the WD circuit, reset information is stored in the storage unit each time the reset signal is outputted to the CPU, the storage unit is formed of a reset counter for counting the number of resets as the reset information, and when being restarted, the CPU implements fail-safe processing, in the case where the value of the reset counter is the same as or larger than a threshold value.

In contrast, Patent Document 3 (Japanese Patent Application Laid-Open No. 2003-155945) discloses an activation-timing fuel injection control apparatus, for an internal-combustion engine, that includes a means for presuming the startability of the internal-combustion engine; a crank-angle detection means for outputting a crank-angle signal in synchronization with the specific crank-angle position of each cylinder of the internal-combustion engine; a cylinder discrimination means for discriminating the reference crank angle of a specific cylinder; a means for starting concurrent injection of a fuel into all the cylinders before, upon the activation of the engine, the cylinder discrimination has been completed; and a means for sequentially starting separate injection for each cylinder in synchronization with the crank-angle signal immediately after the cylinder discrimination has been completed, and in which provision is made for a means for starting the separate injection immediately after the cylinder discrimination has been completed and concurrently injecting the fuel in a cylinder that is ready to take in the fuel, only in the case where it is presumed that the startability of the internal-combustion engine is lower than a predetermined level, whereby, while ensuring the startability, imperfect combustion upon the activation of the engine can be prevented and the amount of HC emissions upon the activation of the engine can be reduced. In addition, related to the present invention, Patent Document 4 (Japanese Patent Application Laid-Open No. 2004-027976) explains in detail a cylinder discrimination method for determining the fuel injection timing and the ignition timing for a multicylinder vehicle engine by use of a crank angle sensor

[Patent Document 1] Japanese Patent Application Laid-Open No. 2006-150999

(Patent Document 2) Japanese Patent Application Laid-Open No. 2003-097345

[Patent Document 3] Japanese Patent Application Laid-Open No. 2003-155945

(Patent Document 4) Japanese Patent Application Laid-Open No. 2004-027976

In the vehicle control apparatus set forth in Patent Document 1, in the case a single microprocessor controls a plurality of apparatuses that are not directly related to one another, the initialization and the restart are performed in order of priority so that the initialization time and the restart time for a preferential load is shortened; however, there exists a problem that, in the case where a single microprocessor controls a plurality of apparatuses that are tightly related to one another, such a divided restart method cannot be applied.

Moreover, in the vehicle electronic control apparatus set forth in Patent Document 2, by performing the monitoring of microprocessor malfunction through a watchdog timer as well as by utilizing the self-diagnosis function of the microprocessor, the safety is enhanced;
however, the shortening of the initialization time and the restart time upon the occurrence of a malfunction is not described.

Furthermore, in Patent Document 3, asynchronous fuel injection for improving the startability of an engine is described; however, no application is anticipated that does not require activation by an starter motor because, before the engine rotation is decelerated after fuel injection in the engine in a high-speed rotation has temporarily been interrupted, the fuel injection is restarted.

SUMMARY OF THE INVENTION

The present invention has been implemented in order to solve the foregoing problems of a conventional apparatus; the object of the present invention is to provide an vehicle-mounted engine control apparatus that shortens the time required for the initialization and the restart of a microprocessor when a malfunction occurs, without impairing the safety of engine control, and that can prevent continuous driving from making the driver sense large discomfort, as long as the malfunction is short-term.

An vehicle-mounted engine control apparatus according to the present invention includes a microprocessor for controlling an engine driving device, in response to an operation status of a driving-condition detection sensor in a multicylinder vehicle engine; a fuel injection control means for collaborating with the microprocessor so as to sequentially open and drive a fuel injection valve, in synchronization with an operation status of a crank angle sensor; a nonvolatile program memory incorporating self-diagnosis means for initializing and restarting the microprocessor in the case where a malfunction occurs; a RAM memory that is supplied with electric power from an on-vehicle battery and a partial region of which is utilized as a keep memory for maintaining a storage state even in the case where a power switch is opened; and a nonvolatile data memory in which, during a delayed power-supply period after the power switch is opened, important data that has been stored in a specific region of the RAM memory and transferred thereto is stored. The program memory further incorporates a control program including an activation inspection means or a restart inspection means that is selected by an initialization determination means and followed by an initialization means for performing writing setting of a predetermined default value for the RAM memory. The initialization determination means is a means for determining whether the activation inspection means, which is performed when an engine is activated, is to be performed or the restart inspection means, which is performed when a malfunction occurs in the microprocessor while the engine is running, is to be performed. The activation inspection means is configured with a plurality of means, among self-diagnosis means, consisting of a transfer inspection means for transferring contents of the data memory to the RAM memory and detecting whether or not any bit information has intruded in the transferred data and whether or not any bit information in the transferred data has been lost; a code inspection means for detecting whether or not any bit information has intruded in the program memory and whether or not any bit information in the program memory has been lost; a reading/writing inspection means for inspecting whether or not reading from and writing in the RAM memory are normally performed; and a disconnection inspection means for inspecting a power-supply circuit for an air-intake-valve driving actuator. The restart inspection means is a memory inspection means that includes at least one of the code inspection means for detecting whether or not any bit information has intruded in the program memory and whether or not any bit information in the program memory has been lost and the reading/writing inspection means for inspecting whether or not reading from and writing in the RAM memory are normally performed, and that is configured with self-diagnosis items simplified compared with the activation inspection means. The self-diagnosis means further include a periodic code inspection means that is approximately periodically performed during the operation of the microprocessor, with regard to partial regions of the program memory and the RAM memory, that resets the microprocessor so as to perform initialization and restart thereof when the occurrence of intrusion or loss of bit information is detected, and that sets a malfunction occurrence flag for a malfunction in the program memory or in the RAM memory. The memory inspection means performed in the restart inspection means is to make inspection of the memory corresponding to the kind of the foregoing malfunction occurrence flag.

In an vehicle-mounted engine control apparatus according to the present invention, by providing an initialization determination means, a restart inspection means, which is simpler than an activation inspection means, is adopted; the contents of the restart inspection are limited to malfunction items detected by a periodic code inspection means during driving of the vehicle. Accordingly, the vehicle-mounted engine control apparatus according to the present invention demonstrates an effect in which the time required for the restart of the microprocessor is shortened so that the engine-drive interruption, which is caused by noise or the like, can be prevented from making the driver sense discomfort. Moreover, the vehicle-mounted engine control apparatus according to the present invention demonstrates an effect in which, in the case where the vehicle might have been parked for a long time, sufficient time is spent so as to perform a meticulous activation inspection, so that the safety can be enhanced.

The foregoing and other object, features, aspects, and advantages of the present invention will become more apparent from the following detailed description of the present invention when taken in conjunction with the accompanying drawings.

BRIEF DESCRIPTION OF THE DRAWINGS

FIG. 3 is a flowchart for explaining the operation of a microprocessor in FIG. 1 while the engine is running;

FIG. 5 is an operation stroke chart for an out-cylinder-injection engine in FIG. 1;

FIG. 6 is an operation stroke chart for an in-cylinder-injection engine in FIG. 1;

FIG. 10 is a flowchart for explaining the operation of an asynchronous fuel injection control means in FIG. 7;

FIG. 11 is an operation stroke chart for an out-cylinder-injection engine in FIG. 7.

DETAILED DESCRIPTION OF THE PREFERRED EMBODIMENTS

Embodiment 1

Figure 1:
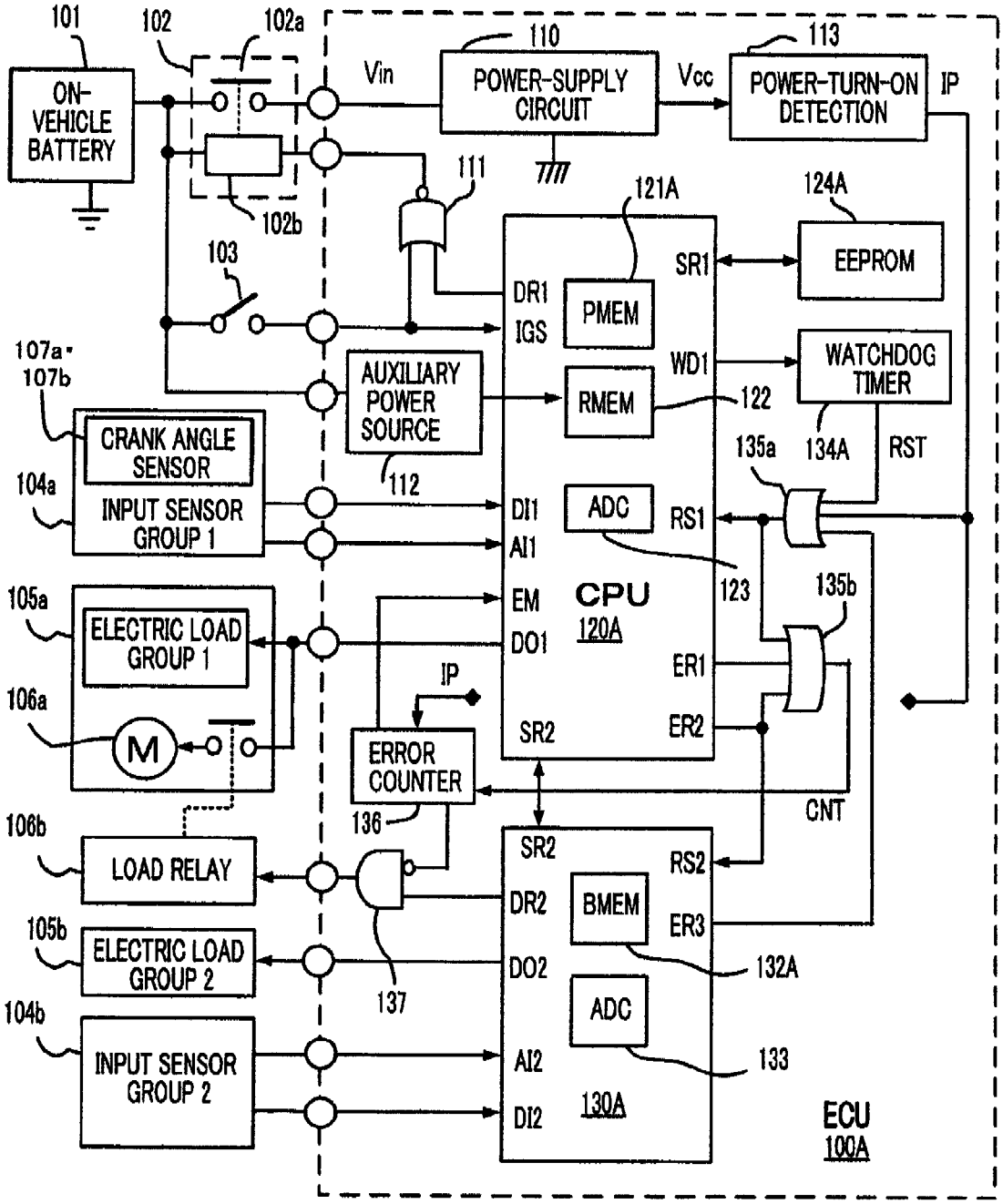
FIG. 1 is a circuit block diagram illustrating the configuration of an vehicle-mounted engine control apparatus according to Embodiment 1 of the present invention.

Embodiment 1 of the present invention will be explained below, with reference to the accompanying drawings. FIG. 1 is a circuit block diagram illustrating the configuration of an vehicle-mounted engine control apparatus according to Embodiment 1 of the present invention. In FIG. 1, electric power is supplied from an on-vehicle battery (simply referred to also as a battery, hereinafter) 101 to an vehicle-mounted engine control apparatus (referred to also as an ECU, hereinafter) 100A, by way of an output contact 102*a* of a power supply relay 102; The power supply relay 102 is configured in such a way that, when a power switch 103 is closed, an excitation coil 102*b* is energized to close the output contact 102*a* and when the power switch 103 is opened and a power switch signal IGS is interrupted, the excitation coil 102*b* is de-energized after a predetermined delay time elapses. A driving-condition detection sensor 104*a* is a first input sensor group that incorporates crank angle sensors 107*a* and 107*b* that each are configured with a plurality of opening/closing sensors provided on an engine crankshaft and on a driving camshaft for an air-intake/exhaust valve and includes an opening/closing sensor, such as an engine rotation sensor or a vehicle speed sensor, which relatively frequently performs opening and closing operation, or an analogue sensor such as an accelerator position sensor for detecting an accelerator-pedal depressing level, a throttle position sensor for detecting a throttle valve opening level, an airflow sensor for measuring an air intake amount, or an exhaust-gas sensor for measuring the oxygen concentration in an exhaust gas. In addition, an input signal from the first input sensor group is connected to a digital input port DI1 and an analogue input port AI1 of a microprocessor (referred to also as a CPU, hereinafter) 120A, by way of an unillustrated input interface circuit.

An engine driving device 105*a* is a first electric load group including an electromagnetic coil for driving a fuel-injection electromagnetic valve, an ignition coil for applying a high voltage to an ignition plug, an exhaust-circulation-valve driving motor, an electric heater for preliminarily heating an exhaust-gas sensor, and the like; The engine driving device 105*a* is adapted to be driven by the microprocessor 120A through an output port DO1 thereof, by way of an unillustrated output interface circuit. A load-power-source relay 106*b* supplies electric power to an air-intake-valve driving actuator 106*a* that is incorporated in the engine driving device 105*a* and feedback-controlled so that the throttle valve opening level corresponds to the accelerator-pedal depressing level. For example, the air-intake-valve driving actuator 106*a* includes a DC motor and when the load-power-source relay 106*b* is de-energized, returns to a predetermined default position so that a limp-home drive at a fixed valve opening level is performed.

A driving-condition detection sensor 104*b* includes analogue sensors, such as an opening/closing sensor for detecting the shift-lever position of the transmission, an analogue sensor for detecting the temperature of cooling water for the engine, accelerator position sensors that are doubly provided, and a throttle position sensor, which configure a second input sensor group that does not frequently operate and that does not have to possess rapid responsiveness. In addition, an input signal from the second input sensor group is connected to a digital input port DI2 and an analogue input port AI2 of a monitoring/controlling circuit 130A, by way of an unillustrated input interface circuit.

An engine driving device 105*b* is a second electric load group that is formed mainly of a sub-device such as a transmission electromagnetic valve or an air-conditioner electromagnetic clutch and that does not frequently operate. The engine driving device 105*b* is adapted to be driven by the monitoring/controlling circuit 130A through an output port DO2 thereof, by way of an unillustrated output interface circuit.

The vehicle-mounted engine control apparatus 100A is configured mainly with the microprocessor 120A and the monitoring/controlling circuit 130A. A power-supply circuit 110 receives electric power from the battery 101 by way of the output contact 102*a* of the power supply relay 102, generates various kinds of stabilized control power-supply voltages Vcc, and supplies electric power to the microprocessor 120A, the monitoring/controlling circuit 130A, and the peripheral circuits and the input and output interface circuits of the microprocessor 120A and the monitoring/controlling circuit 130A. A drive element 111 is configured in such a way that it energizes the excitation coil 102*b* when the power switch 103 is closed and receives as a logic-sum input a self-hold command signal DR1 from the microprocessor 120A, and when the power switch 103 is once closed, it can keep the excitation coil 102*b* energized until the self-hold command signal DR1 is interrupted. An auxiliary power source 112 is adapted to always receive electric power from the battery 101 and supply electric power to a keep memory as part of region of a RAM memory 122 so that, even after the power supply relay 102 is de-energized, important data items such as learning/storage data and malfunction-history information data are stored and retained. After the power switch 103 is closed and the power-supply circuit 110 generates the control output voltage Vcc, a power-on detection circuit 113 generates an initial pulse IP so as to initialize and activate the microprocessor 120A and to reset a malfunction storage/determination circuit 136 described later.

The microprocessor 120A incorporates a program memory 121A, such as a nonvolatile flash memory, in which a control program and control constants are written through an unillustrated external tool, the RAM memory 122 for calculation processing, and a multichannel AD converter 123. A data memory 124A is a nonvolatile memory, such as an EEPROM, which is serially connected by way of a serial port SR1 to the microprocessor 120A; important data items, such as important learning data that require a long time to learn, the temporal-change characteristics in important sensors, and malfunction-history information, in the keep memory are transferred to and stored in the data memory 124A so that loss of the important data due to abnormal voltage reduction of the battery 101, a power cutoff upon replacement of the battery, or the like is prevented.

The monitoring/controlling circuit 130A is serially connected by way of a serial port SR2 to the microprocessor 120A and is configured with a volatile buffer memory 132A to which the program memory 121A transfers the control constants and an integrated circuit element (LSI) including a calculation circuit unit.

When the period of a watchdog signal WD1 that is generated by the microprocessor 120A exceeds a predetermined threshold value, a watchdog timer 134A generates a reset output RST so as to initialize and restart the microprocessor 120A.

A logical-sum element 135*a* makes a logical sum of the reset output RST, the initial pulse IP, and a main-portion-malfunction detection signal ER3 described later and supplies a reset input signal RS1 to the microprocessor 120A; a logical-sum element 135*b* makes a logical sum of the reset signal RS1, a self-checked-malfunction detection signal ER1 described later, and a assist-portion-malfunction detection signal ER2 described later and generates a malfunction count signal CNT for the malfunction storage/determination circuit 136.

The malfunction storage/determination circuit 136 is reset by the initial pulse IP when the power is turned on, and then counts an occurrence number of the malfunction count signal CNT; when the count value exceeds a predetermined value, the malfunction storage/determination circuit 136 de-energizes the load-power-source relay 106*b* by the intermediary of a gate element 137 and supplies a limp-home drive command signal EM to the microprocessor 120A.

The microprocessor 120A generates a load-power-source power-on command signal DR2 by the intermediary of the serial port SR2 and the monitoring/controlling circuit 130A, and then drives the load-power-source relay 106*b* by the intermediary of the gate element 137. The microprocessor 120A is provided with various diagnosis functions described later; when a malfunction occurs in its control operation, the microprocessor 120A resets itself so as to initialize and restart itself, and generates the self-checked-malfunction detection signal ER1 which is added and counted, as the malfunction count signal CNT for the malfunction storage/determination circuit 136.

Furthermore, when a malfunction occurs in its serial communication with the monitoring/controlling circuit 130A, the microprocessor 120A generates the assist-portion-malfunction detection signal ER2, so that the malfunction storage/determination circuit 136 adds and counts the occurrence of the malfunction; after receiving a reset input signal RS2 based on the assist-portion-malfunction detection signal ER2, the monitoring/controlling circuit 130A initializes the buffer memory 132A.

Part 104*b* of the driving-condition detection sensor and part 105*b* of the engine driving device are connected to the monitoring/controlling circuit 130A; the monitoring/controlling circuit 130A serially communicates with the microprocessor 120A with regard to the input and output signals and generates an inquiry signal intended for the microprocessor 120A; in the case where an answer signal, from the microprocessor 120A, to the inquiry signal does not coincide with correct-solution information that has been preliminarily transferred from the program memory 121A to the buffer memory 132A, the monitoring/controlling circuit 130A generates the main-portion-malfunction detection signal ER3 so as to reset and restart the microprocessor 120A.

Figure 2:
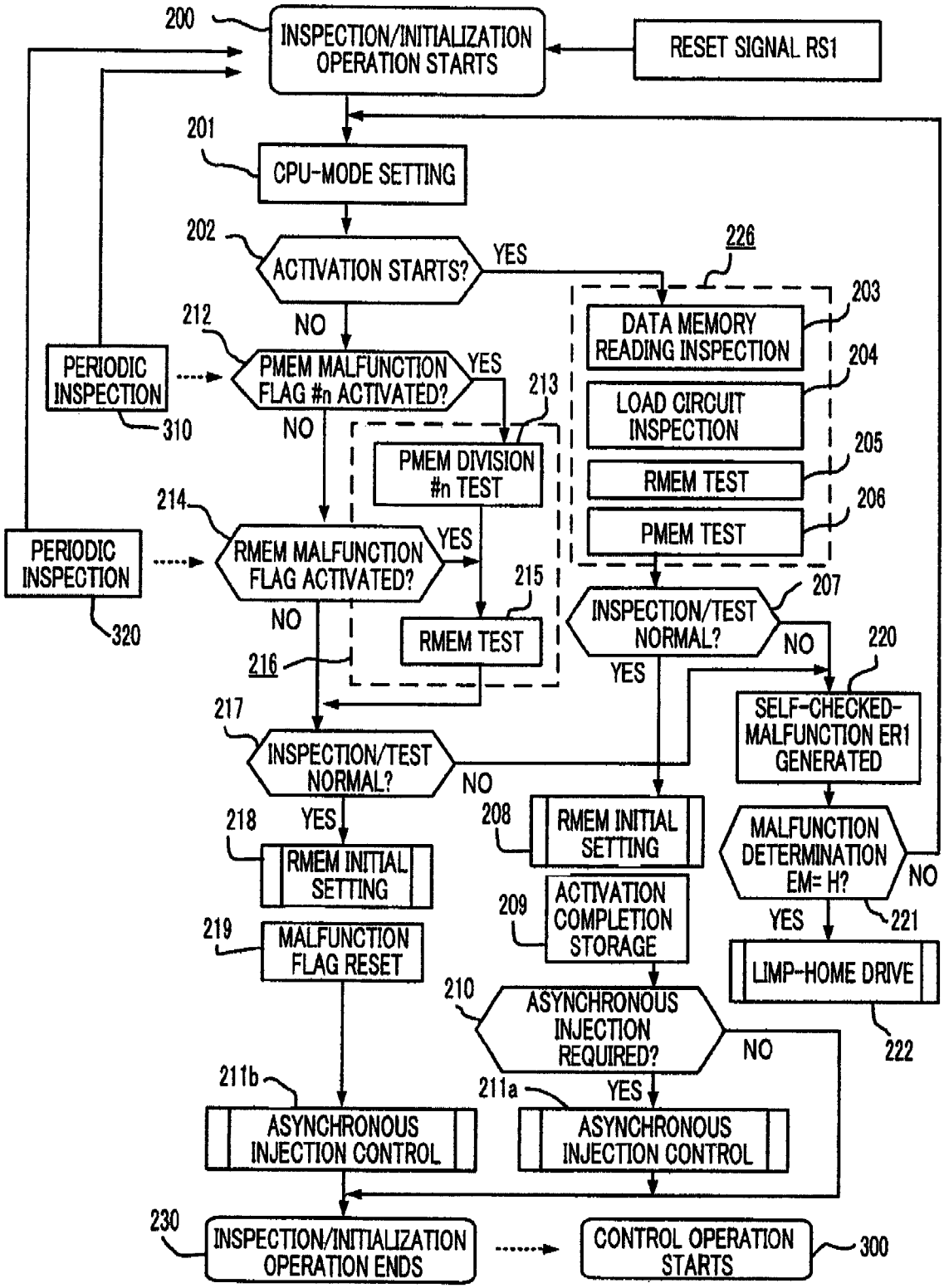
FIG. 2 is a flowchart for explaining the operation of initializing a microprocessor in FIG. 1.

With regard to the vehicle-mounted engine control apparatus, according to Embodiment 1, configured as described above, in the first place, the outline of the operation of the circuitry in FIG. 1 will be explained. In FIG. 1, when the power switch 103 is closed, the excitation coil 102*b* is energized through the drive element 111, and the output contact 102*a* of the power supply relay 102 is closed, so that a power-source-terminal voltage Vin from the battery 101 is applied to the power-supply circuit 110. The power-supply circuit 110 generates the various stabilized control power-supply voltages Vcc and supplies the control power-supply voltages Vcc to the units in the ECU 100A; the power-on detection circuit 113 generates the initial pulse IP so as to reset the present count value in the malfunction storage/determination circuit 136, and supplies the reset input signal RS1 to the CPU 120A by the intermediary of the logical-sum element 135*a*. As a result, the initialization operation illustrated in FIG. 2 is started; when the CPU 120A is normally activated, the controlling operation illustrated in FIG. 3 is performed, so that the engine driving devices 105*a* and 105*b* are driven and controlled, in accordance with the operation statuses of the driving-condition detection sensors 104*a* and 104*b* and with an input/output control program stored in the program memory 121A. The CPU 120A performs a malfunction inspection on its own inside through a self-diagnosis function described later; when a malfunction occurs, the CPU 120A resets itself so as to perform the initialization operation illustrated in FIG. 2, thereby restarting itself, and generates the self-checked-malfunction detection signal ER1, so that the malfunction storage/determination circuit 136 counts the occurrence of the malfunction.

The watchdog timer 134A monitors the pulse width of the watchdog signal WD1 generated by CPU 120A; when the pulse width exceeds a predetermined value, the watchdog timer 134A generates the reset output RST so as to reset the CPU 120A, the initialization operation illustrated in FIG. 2 is performed, the CPU 120A is restarted, and then the malfunction storage/determination circuit 136 counts the occurrence of the malfunction.

The monitoring/controlling circuit 130A monitors the status of control by the CPU 120A; when the answer from the CPU 120A is abnormal, the monitoring/controlling circuit 130A generates the main-portion-malfunction detection signal ER3 so as to reset the CPU 120A, the initialization operation illustrated in FIG. 2 is performed, the CPU 120A is restarted, and then the malfunction storage/determination circuit 136 counts the occurrence of the malfunction.

When the communication answer of the monitoring/controlling circuit 130A is abnormal, the CPU 120A generates the assist-portion-malfunction detection signal ER2, the monitoring/controlling circuit 130A initializes the buffer memory 132A, and then the malfunction storage/determination circuit 136 counts the occurrence of the malfunction. When the count value stored in the malfunction storage/determination circuit 136 exceeds a predetermined value, the gate element 137 de-energizes the load-power-source relay 106*b* so as to return the air-intake-valve driving actuator 106*a* to its initial position, and the limp-home drive command signal EM is inputted to the CPU 120A, so that the limp-home drive control is performed at the fixed throttle valve opening level.

Next, FIG. 2, which is a flowchart for explaining the initialization operation of the microprocessor 120A illustrated in FIG. 1, will be explained. In FIG. 2, the step 200 is an inspection/initialization operation starting step in which the microprocessor 120A is activated when a malfunction is detected through a self-inspection by an activation inspection means 226, a restart inspection means 216, and periodic code inspection means 310 and 320 that are described later, or when the reset input signal RS1 is inputted to the microprocessor 120A. The step 201 is a CPU basic mode setting step in which the setting of the communication speed of the microprocessor 120A, "interrupt enable", "interrupt disable", and "interruption priority" and an interrupt request flag are cleared. The process 202 is a step, corresponding to an initialization determination means, in which whether an activation inspection 226 is performed or a restart inspection 216 is performed is selected; upon the first operation after the power is turned on, "YES" determination is made, the process 202 is followed by the process 203 in the activation inspection means 226, and activation completion storage is carried out in the process 209 described later, so that, from the next initialization determination onward, "NO" determination is made and the process 202 is followed by the process 212.

The process 203 is a step, corresponding to a transfer inspection means, in which the content of the data memory 124A is read and transferred to an empty region of the RAM memory 122 and inspected with regard to whether or not any code error exists, for example, through a CRC check (cyclic redundancy checksum). The process 204 is a step, corresponding to a disconnection inspection means 204, in which whether or not the power-supply circuit for the air-intake-valve driving actuator 106*a* is enabled to be disconnected by the load-power-source relay 106*b*, or whether or not the opening/closing element for controlling the air-intake-valve driving actuator 106*a* functions normally is inspected. The process 205 is a step, corresponding to a reading/writing inspection means, in which whether or not writing and reading of "1" and "0" can be carried out for each of the all bits of the RAM memory 122 is inspected. The process 206 is a step, corresponding to a code inspection means, in which, for the overall region of the program memory 121A, whether or not any code error exists is inspected, for example, through a sum check with regard to whether or not the sum value and the expected value coincide with each other; the process block 226 configured with the processes 203 to 206 is the activation inspection means.

The process 207 is a step for determining whether or not a malfunction exists; in the process 207, whether or not all the inspection tests in the process block 226 prove that no malfunction exists is determined, and in the case where no malfunction exists, the process 207 is followed by the process block 208; however, in the case where any malfunction exists, "NO" determination is made and the process 207 is followed by the process 220.

The process block 208 is a step, corresponding to an initialization means, in which the initial setting of the RAM memory 122 is performed; in the case where the power switch 103 is turned on for the first time after the battery 101 is connected and then the process 208 is performed, the initial setting of the overall region of the RAM memory 122 is carried out in the process 208.

First content of the initial setting is the setting of a default value for most important data that has been preliminarily transferred, at the stage of product shipping, from the program memory 121A to the data memory 124A; the default value is transferred from the data memory 124A to a first region of the RAM memory 122; second content of the initial setting is the setting of a default value for important data to be stored in the keep memory that is incorporated in the RAM memory 122 and backed up with a battery; the default value for the important data is transferred from the program memory 121A to a second region of the RAM memory 122; third content of the initial setting is the setting of clearing data for erasing the present data; normally, data "0" is transferred to a third region of the RAM memory 122. In addition, through the process 302 (refer to FIG. 3) described later, the first content is written, as learning correction data based on the most important data, in the data memory 124A to update the previous content. After being once transferred to and stored in the data memory 124A, in the initialization in the process block 208, the first content is updated data read from the data memory 124A; the second content is not updated and the present data is maintained; and the third content is erased. In addition, the most important data and the important data that are stored in the RAM memory 122 are each a pair of positive logic data and reverse logic data; in a periodic inspection described later, a reverse logic comparison is made so as to determine whether or not a malfunction exists; in the initialization, only the data at an address where a malfunction has occurred is rewritten.

In the process 209, because the activation inspection in the process block 226 has been positively passed, an activation completion state is stored. In addition, the activation completion storage is reset when the power switch 103 is once opened and then again closed; therefore, immediately after the power source is turned on, "YES" determination is definitely made in the process 202, whereby the activation inspection 226 and the accompanying initialization setting 208 are performed.

In the process 220 that is performed when a malfunction is found in the activation inspection, the self-checked-malfunction detection signal ER1 is generated, and in the process 221, it is determined whether or not the limp-home drive command signal EM has been inputted from the malfunction storage/determination circuit 136 to the microprocessor 120A; in the case where the limp-home drive command signal EM has been inputted to the microprocessor 120A, "YES" determination is made and the process 221 is followed by the process 222 corresponding to a limp-home drive means; in the case where the limp-home drive command signal EM has not been inputted to the microprocessor 120A, "NO" determination is made and the process 221 is followed by the process 201 again. Accordingly, in the case where some sort of hardware malfunction exists in the vehicle-mounted engine control apparatus 100A and the activation inspection means 226 detects the malfunction, the malfunction is always detected each time the activation inspection is performed; whenever the processes 201, 202 to 207, 220, and 221 are circularly performed, when the self-checked-malfunction detection signal ER1 occurs in the process 220, the malfunction storage/determination circuit 136 performs counting, and when the limp-home drive command signal EM occurs, the process 221 is followed by the limp-home drive mode.

After the activation inspection has positively been passed and the activation completion is stored in the process 209, it is determined, in the process 210, whether or not asynchronous fuel injection is required to be performed; in the case where the asynchronous fuel injection is not required, "NO" determination is made and the process 210 is followed by the operation end process 230 where the initialization is completed; in the case where the asynchronous fuel injection is required, "YES" determination is made and the process 210 is followed by the operation block 211*a* and then followed by the operation end process 230 where the initialization is completed. In addition, in the process 210 corresponding to a necessity determination means, "YES" determination is made in the case where the activation switch for the engine is being turned on or the engine is in a low-speed rotation mode in which it cannot rotate by itself and when the output voltage of the battery 110 is abnormally low or the drive of the starter motor under a low-voltage and low-temperature environment is required. The asynchronous fuel injection control in the process 211*a* will be explained in detail with reference to FIG. 4.

After the inspection and the initialization are completed in such a manner as described above, input/output control operation, described later with reference to FIG. 3, is started, whereupon the engine is brought into a steady drive state; however, when, during the steady drive, a malfunction is detected in the processes 310 and 320 corresponding to the periodic code inspection means, each of the processes 310 and 320 is followed by the process 200 in FIG. 2 and the inspection/initialization operation is started.

The process 212 is a step in which it is determined whether or not a malfunction flag #n in the program memory 121A has been set in the process 314 in FIG. 3; in the case where the malfunction flag has been set, "YES" determination is made and the process 212 is followed by the process 212; in the case where the malfunction flag has not been set, "NO" determination is made and the process 212 is followed by the process 214. The process 213 is a step, corresponding to a code inspection means, in which, for the divided block #n of the program memory 121A, whether or not any code error exists is inspected, for example, through a sum check with regard to whether or not the sum value and the expected value coincide with each other; the process 213 is followed by the process 215. The process 214 is a step in which it is determined whether or not a malfunction flag in the RAM memory 122 has been set in the process 324 in FIG. 3; in the case where the malfunction flag has been set, "YES" determination is made and the process 214 is followed by the process 215; in the case where the malfunction flag in the RAM memory 122 has not been set, "NO" determination is made and the process 214 is followed by the process 217.

The process 215 is a step, corresponding to a reading/writing inspection means, in which it is inspected whether or not writing and reading of "1" and "0" can be carried out for the bits for an address, corresponding to the occurrence of a malfunction, of the RAM memory 122; the process 215 is followed by the process 217. In addition, the periodic inspection of the RAM memory 122 performed in the process 320 described later is a discrete-code inspection of specific important data, for example, through comparison with reverse data; in contrast, the inspection of the RAM memory 122 performed in the process 215 is to inspect whether or not a hardware malfunction exists. Additionally, the process block 216 configured with the processes 213 and 215 is the restart inspection means.

The process 217 is a step, for determining whether or not a malfunction exists, in which it is determined whether or not all the inspection tests in the process block 216 prove that no malfunction exists; in the case where no malfunction exists, "YES" determination is made and the process 217 is followed by the process block 218; however, in the case where any malfunction exists, "NO" determination is made and the process 217 is followed by the process 220. The process block 218 is a step, corresponding to an initialization means, in which the initial setting of the RAM memory 122 is performed; in the process block 218 corresponding to the initialization means after the restart inspection, with regard to data for an address, corresponding to the occurrence of a malfunction, which has been detected through the periodic inspection, data is read from the data memory 124A and set or the default value in the program memory 121A is read and set. The process 219 is a step in which a malfunction flag set in the process 313 or 324 in FIG. 3 is reset. The process block 211*b* is a step, corresponding to an asynchronous fuel injection control means described later with reference to FIG. 4, in which an asynchronous fuel injection is carried out and that is followed by the operation end process 230 where the initialization is completed; the operation end process 230 is followed by the control operation start process 300.

Explaining the outline of the operation described above, upon the start of the engine, the condition inspection of the vehicle-mounted engine control apparatus 100A is performed in detail through the activation inspection means 226. Upon the activation inspection, there exist a hesitation time from the moment when the power switch 103 is closed to the moment when the engine activation switch is closed and an initial response time from the moment when the activation switch is closed to the moment when the rotation speed of the engine reaches a minimally necessary speed at which the fuel injection control and the ignition control can be performed; it is only necessary to complete the activation inspection within the foregoing grace time. In contrast, in the restart inspection means 216 performed in response to the occurrence of a contingent malfunction while the engine is running, it is desirable that, when the fuel injection and the ignition control are resumed after the restart, the rotation of the engine can be maintained; ideally, it is required that the engine continues to run without making the driver sense discomfort. Accordingly, in the restart inspection means 216, it is important to perform the inspection focused on the cause of a malfunction upon the periodic inspection; therefore, no inspection having the same content as that of the activation inspection means 226 is performed. In addition, even in the case of the occurrence of a contingent malfunction, e.g., due to erroneous operation caused by noise, when the number of the occurrences of malfunctions exceeds, the engine moves to the limp-home drive mode so as not to deteriorate the safety.

Next, FIG. 3, which is a flowchart for explaining the operation, of the microprocessor 120A illustrated in FIG. 1, while the engine is running will be explained. In FIG. 3, the process 300 is a step in which the input/output control operation, which is carried out following the initialization completion process 230, is started; the process 301 is a determination step in which whether or not the power switch 103 is closed, and in the case where the power switch 103 is closed, "YES" determination is made and the process 301 is followed by the process 306, and in the case where the power switch 103, which has been once closed, is opened, "NO" determination is made and the process 301 is followed by the process 302. The process block 306 corresponding to an input/output control means is configured with a cylinder discrimination means 306*a*, a fuel injection control means 306*b*, and an ignition coil control means 306*c* that sequentially perform the fuel injection and the ignition control, through the crank angle sensors 107*a* and 107*b* that each are configured with a plurality of opening/closing sensors provided on the engine crankshaft and on the driving camshaft for the air-intake/exhaust valve; and a valve opening level control means 306*d* that controls the valve opening level of an air-intake throttle valve, in response to an accelerator-pedal depressing level. In addition, in the fuel injection control means 306*b*, negative-feedback control is performed in which the air-fuel ratio is maintained to be a predetermined value, by means of an exhaust-gas sensor; in the ignition coil control means 306*c*, negative-feedback control of the ignition timing is performed by means of a knock sensor for measuring the vibration of the engine.

The process 307*a* is a determination step in which it is determined whether or not the inspection timing for the program memory 121A has come; in the case where the inspection timing for the program memory 121A has come, "YES" determination is made and the process 307*a* is followed by the process 311; in the case where the inspection timing for the program memory 121A has not come, "NO" determination is made and the process 307*a* is followed by the process 307*b*. The process 311 is a step, corresponding to a code inspection means, in which, for the divided block #n of the program memory 121A, whether or not any code error exists is inspected, for example, through a sum check with regard to whether or not the sum value and the expected value coincide with each other, and that is followed by the process 312; each time the process 311 is performed, the inspection block number is set in such a way as to be circularly updated. In the process 312, it is determined whether or not any malfunction has been detected in the process 311; in the case where any malfunction has been detected, "YES" determination is made and the process 312 is followed by the process 313; in the case where no malfunction has been detected, "NO" determination is made and the process 312 is followed by the process 307*b*. In the process 313, the malfunction flag #n is set and the malfunction detection signal ER1 is generated; in the process 314, the microprocessor 120A is reset, and then the process 314 is followed by the process 200 in FIG. 2. In addition, the malfunction flag #n that has been set in the process 313 is reset in the process 219 in FIG. 2.

The process 307*b* is a determination step in which whether or not the inspection timing for the RAM memory 122 has come; in the case where the inspection timing for the RAM memory 122 has come, "YES" determination is made and the process 307*b* is followed by the process 321; in contrast, in the case where the inspection timing for the RAM memory 122 has not come, "NO" determination is made and the process 307*b* is followed by the operation end process 330. The process 321 is a step, corresponding to a code inspection means, in which, for the most important data and the important data in the RAM memory 122, whether or not any code error exists is inspected, for example, through a reverse logic comparison, and that is followed by the process 322; In the malfunction inspection performed in the process 322, the address, of the RAM memory 122, which corresponds to the occurrence of a malfunction is localized. In the process 322, it is determined whether or not any malfunction has been detected in the process 321; in the case where any malfunction has been detected, "YES" determination is made and the process 322 is followed by the process 323; in the case where no malfunction has been detected, "NO" determination is made and the process 322 is followed by the process 330. In the process 323, a RAM malfunction flag is set and the malfunction detection signal ER1 is generated; in the process 324, the microprocessor 120A is reset, and then the process 324 is followed by the process 200 in FIG. 2. In addition, the RAM malfunction flag that has been set in the process 323 is reset in the process 219 in FIG. 2.

In the operation end process 330, other control operation items are performed, and a predetermined time (e.g., within 10 msec) later, the operation end process 330 is circularly followed by the operation start process 300. The process block 310 configured with the processes 311 to 314 and the process block 320 configured with the processes 321 to 324 correspond to respective periodic code inspection means for the program memory 121A and the RAM memory 122; one periodic inspection by each of the periodic code inspection means 310 and 320 is completed through a plurality times of circular operation of a series of input/output control consisting of the processes 300 to 330; distributed operation is performed in such a way that the result of one periodic inspection can be obtained, for example, once per 100 msec.

In the process 302 that is performed after the power switch 103 is opened, the most important data that has been stored in a transfer/storage region of the RAM memory 122 is corrected through learning correction during driving of the vehicle and, as the latest learning data, transferred to and stored in the data memory 124A. The process 303 is a step in which specific data YY is written in a memory RAMa located in a specific address of a second region as the keep memory region of the RAM memory 122; the change, in the content of the specific data YY, which is caused, for example, by the power-source terminal of the battery 101 being opened is detected. In the process 304, the self-hold command signal DR1 is interrupted and the microprocessor 120A is reset; as a result, the power supply relay 102 is de-energized and then the operation of the vehicle-mounted engine control apparatus 100A stops.

Figure 4:
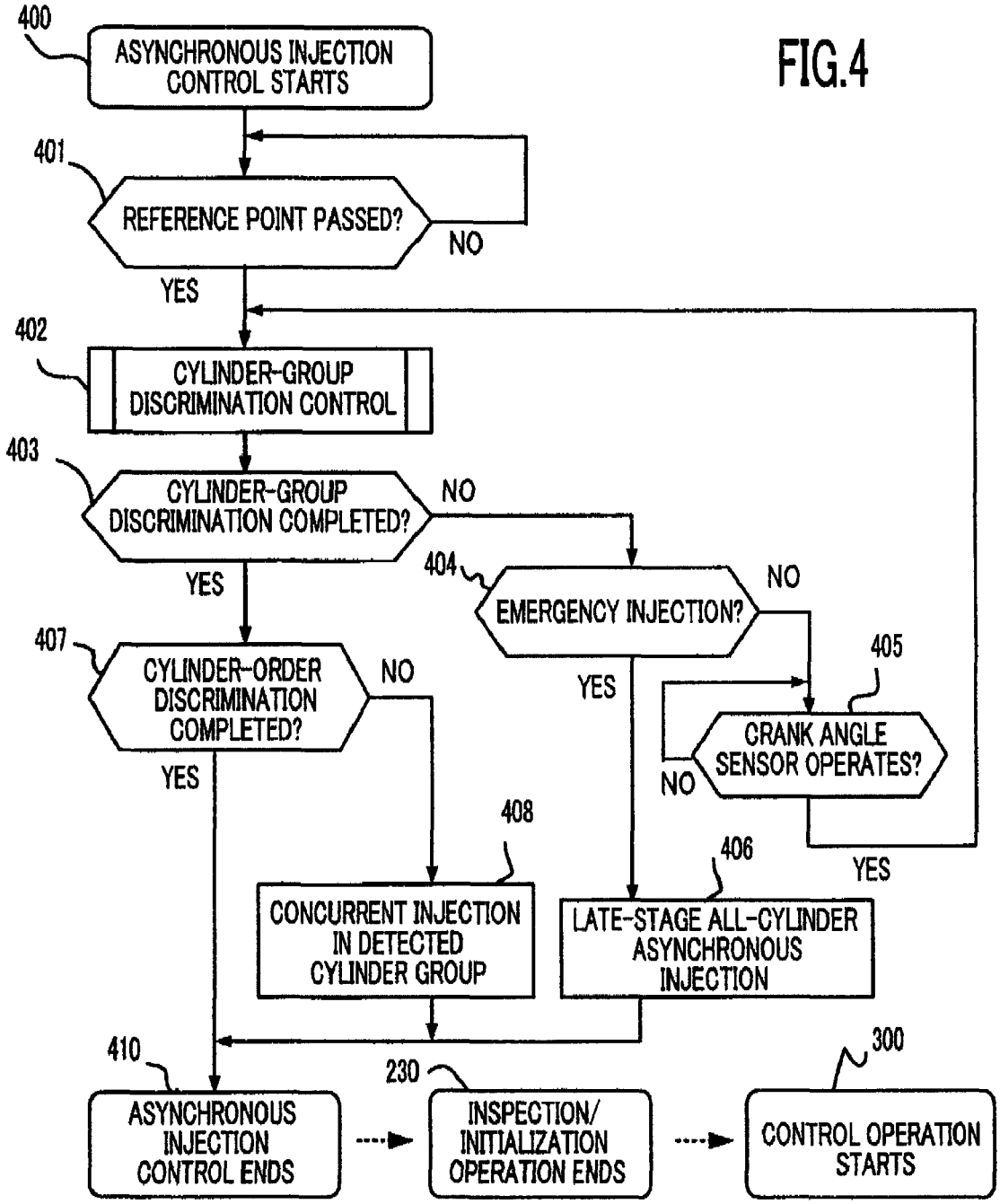
FIG. 4 is a flowchart for explaining the operation of an asynchronous fuel injection control means in FIG. 1.

Next, FIG. 4, which is a flowchart for explaining the operation of the asynchronous fuel injection control in the vehicle-mounted engine control apparatus according to Embodiment 1, will be explained. In FIG. 4, the process 400 is a step in which the operation of each of the asynchronous fuel injection control means illustrated as the process blocks 211*a* and 211*b* in FIG. 2 starts. The process 401 is a determination step in which it is determined whether or not the crank angle sensor 107*a*, out of the crank angle sensors 107*a* and 107*b*, which is provided on the crankshaft has passed the position of a reference point; in the case where the crank angle sensor 107*a* has passed the reference-point position, the process 401 is followed by the process 402. As far as the reference point is concerned, the crank angle sensor 107*a* facing a rotating disk, provided on the crankshaft and having teeth in steps of 10 degrees on the circumferential surface thereof, detects a missing-tooth portion provided in the rotating disk, so that the passage of the reference point is detected. The process block 402 corresponds to a cylinder discrimination means by which, while the processes 403, 404, and 405 described later are circularly passed, the operation statuses of the crank angle sensor 107*a* that responds to the rotation of the crankshaft and the crank angle sensor 107*b* that responds to the rotation of the air-intake-valve camshaft are monitored so that the cylinder groups are discriminated from one another and discrimination control for deciding the fuel injection timing and the ignition timing for each cylinder is performed. In addition, the cylinder discrimination means completes the discrimination among all the cylinders in a time period from the moment when the cylinder discrimination stars to the moment when the engine has rotated maximally twice; however, the discrimination among the cylinder groups is completed earlier than the discrimination among all the cylinders is completed.

The process 403 is a determination step in which it is determined whether or not the discrimination among the cylinder groups has been completed in the process block 402; in the case where the discrimination among the cylinder groups has not been completed, "NO" determination is made and the process 403 is followed by the process 404; in contrast, in the case where the discrimination among the cylinder groups has been completed, "YES" determination is made and the process 403 is followed by the process 407. The process 404 is a step, corresponding to an early-injection determination means, in which it is determined whether or not an emergency injection is required; in the case where an emergency injection is required, "YES" determination is made and the process 404 is followed by the process 406; in the case where no emergency injection is required, "NO" determination is made and the process 404 is followed by the process 405. In addition, in the early-injection determination means 404 in the asynchronous fuel injection control means 211*b* performed following the restart inspection means 216, it is determined that the emergency injection is required, in the case where memory inspection on the program memory 121A is performed in the restart inspection means 216; it is determined that no emergency injection is required, in the case where only the memory inspection on the RAM memory 122 is performed in the restart inspection means 216. Additionally, in the early-injection determination means 404 in the asynchronous fuel injection control means 211*a* performed following the restart inspection means 226, it is determined that the emergency injection is required, in the case where the ambient temperature and the voltage of the on-vehicle battery are in predetermined inadequate conditions; in the case where the ambient temperature and the voltage of the on-vehicle battery are in predetermined adequate conditions that are not necessarily inadequate conditions, it is determined that no emergency injection is required.

The process 405 is a determination step in which whether or not either one of the crank angle sensors 107*a* and 107*b* has operated; in the case where neither one of the crank angle sensors 107*a* and 107*b* has operated, "NO" determination is made and the process 405 is resumed; in the case where either one of the crank angle sensors 107*a* and 107*b* has operated, "YES" determination is made and the process 405 is circularly followed by the process 402. The process 406 is a step, corresponding to a first asynchronous fuel injection control means, in which a first asynchronous injection, described later with reference to FIG. 5(C), is performed. The process 407 is a determination step in which it is determined whether or not the discrimination among all the cylinders has been completed in the process block 402; in the case where the discrimination has not been made, "NO" determination is made and the process 407 is followed by the process 408; in the case where the discrimination has been made, "YES" determination is made and the process 407 is followed by the process 410. The process 408 is a step, corresponding to a second asynchronous fuel injection control means, in which a second asynchronous injection, described later with reference to FIG. 5(B), is performed. The process 406 or the process 408 is followed by the operation end process 410, and then the operation end process 230 in FIG. 2 and the operation start process 300 in FIG. 3 are passed through, so that synchronous injection, illustrated as the fuel injection control means 306*b*, is performed.

Next, FIG. 5, which is an operation stroke chart in the case where, in the vehicle-mounted engine control apparatus in FIG. 1, an out-cylinder-injection engine is utilized will be explained. In addition, the term "out-cylinder injection" here denotes the phenomenon that a fuel injected in the exhaust stroke stays in the air-intake pipe situated outside an engine cylinder, and then absorbed into the cylinder when the cylinder-wall intake valve of the engine is opened. FIG. 5(A) is a chart representing a fuel injection timing I and an ignition timing IG in the case where a normal synchronous injection is performed. The fuel injection I is performed in the exhaust stroke of each of the cylinders, and the ignition IG is performed in the compression stroke; hereinafter, the fuel injection and the combustion operation will intensively be explained. When the cylinder discrimination is started in the air-intake stroke of the cylinder 1, the cylinder discrimination is completed in the exhaust stroke of the cylinder 2 which has been in the compression stroke at this timing, an initial fuel injection 52*b* is performed, and then initial combustion 55 occurs in the combustion stroke of the cylinder 2; after that, the cylinders 1, 3, and 4, in that order, are brought into effective combustion strokes 56, 57, and 58, respectively.

FIG. 5(B) is a chart representing a case where a cylinder-group concurrent injection is performed by the second asynchronous fuel injection control means 408; a fuel injection 51*d* is performed in the exhaust stroke of the cylinder 4, and at the same time, an asynchronous concurrent injection 51*a* is performed in the compression stroke of the cylinder 1. At this timing, however, it is not determined which cylinder is in the exhaust stroke and which cylinder is in the compression stroke, but it is determined only that one of them is in the exhaust stroke. As a result, initial combustion 54 occurs based on the fuel injection 51*d* of the cylinder 4; thus, the initial combustion occurs one stroke earlier than the initial combustion in FIG. 5(A). However, in the cylinder 1, based on two fuel injections, i.e., the concurrent fuel injection 51*a* and a fuel injection 53*a* in the exhaust stroke, combustion occurs in the combustion stroke 56; therefore, it is required to allow the excess fuel to increase the amount of poisonous exhaust gases. In addition, it is possible to halt the fuel injection 53*a*; however, in this case, in the combustion in the combustion stroke 56, the fuel becomes rare, whereby the amount of poisonous gases increases.

FIG. 5(C) is a chart representing a case where concurrent injection for all the cylinders is performed by the first asynchronous fuel injection control means 406; the fuel injection 51*d* is performed in the exhaust stroke of the cylinder 4, and at the same time, the asynchronous concurrent injection 51*a* is performed in the compression stroke of the cylinder 1; furthermore, at the same time, the fuel injection 51*b* is performed in the combustion stroke of the cylinder 2, and the fuel injection 51*c* is performed in the air-intake stroke of the cylinder 3. However, at this timing, the respective present strokes of the cylinders are by no means discriminated; the cylinder 4 is accidentally in the exhaust stroke. As a result, initial combustion 53 occurs based on the fuel injection 51*c* of the cylinder 3; thus, the initial combustion occurs further one stroke earlier than the initial combustion in FIG. 5(B). However, in the cylinder 1, based on two fuel injections, i.e., the concurrent fuel injection 51*a* and the fuel injection 53*a* in the exhaust stroke, combustion occurs in the combustion stroke 56, and in the cylinder 2, based on two fuel injections, i.e., the concurrent fuel injection 51*b* and the fuel injection 52*b* in the exhaust stroke, combustion occurs in the combustion stroke 55; therefore, it is required to allow the excess fuel to further increase the amount of poisonous exhaust gases.

Next, FIG. 6, which is an operation stroke chart in the case where, in the vehicle-mounted engine control apparatus in FIG. 1, an in-cylinder-injection engine is utilized will be explained. In addition, the term "in-cylinder injection" here denotes the phenomenon that, in the air-intake stroke, a fuel is directly injected into a cylinder of the engine and only air is taken in through the air-intake valve. FIG. 6(A) is a chart representing the fuel injection timing I and the ignition timing IG in the case where a normal synchronous injection is performed. The fuel injection I is performed in the air-intake stroke of each of the cylinders, and the ignition IG is performed in the compression stroke; hereinafter, the fuel injection and the combustion operation will intensively be explained.

When the cylinder discrimination is started in the air-intake stroke of the cylinder 1, the cylinder discrimination is completed in the air-intake stroke of the cylinder 4 which has been in the combustion stroke at this timing, an initial fuel injection 62*d* is performed, and then initial combustion 64 occurs in the combustion stroke of the cylinder 4; after that, the cylinders 2, 1, 3, and 4, in that order, are brought into effective combustion strokes 65, 66, 67, and 68, respectively.

FIG. 6(B) is a chart representing a case where a cylinder-group concurrent injection is performed by the second asynchronous fuel injection control means 408; a fuel injection 61*c* is performed in the air-intake stroke of the cylinder 3, and at the same time, an asynchronous concurrent injection 61*b* is performed in the combustion stroke of the cylinder 2. At this timing, however, it is not determined which cylinder is in the air-intake stroke and which cylinder is in the combustion stroke, but it is determined only that one of them is in the air-intake stroke. As a result, initial combustion 63 occurs based on the fuel injection 61*c* of the cylinder 3; thus, the initial combustion occurs one stroke earlier than the initial combustion in FIG. 6(A). However, in the cylinder 2, based on two fuel injections, i.e., the concurrent fuel injection 61*b* and a fuel injection 63*b* in the air-intake stroke, combustion occurs in the combustion stroke 65; the fuel injection 61*b* in the combustion stroke is kept unburned until it is exhausted in the following exhaust stroke, because ignition is not performed. In addition, in the case of the in-cylinder injection, the time period between the moment of fuel injection and the moment of ignition is shortened by one stroke, compared with the out-cylinder injection; therefore, the initial-combustion timing is also advanced by one stroke. However, even though concurrent injection of all the cylinder is performed, the injection is effective only in a single cylinder; therefore, the initial-combustion timing cannot be advanced, but the amount of raw gas to be exhausted is unnecessarily increased and no effect is demonstrated.

Gist and Features of Embodiment 1

As is clear from the foregoing explanation, the vehicle-mounted engine control apparatus 100A according to Embodiment 1 of the present invention includes the microprocessor 120A for controlling the engine driving devices 105*a* and 105*b* in response to the operation statuses of the driving-condition detection sensors 104*a* and 104*b* in a multicylinder vehicle engine; the fuel injection control means 306*b* for collaborating with the microprocessor so as to sequentially open and drive a fuel injection valve, in synchronization with the operation statuses of the crank angle sensors 107*a* and 107*b*; the nonvolatile program memory 121A incorporating self-diagnosis means for initializing and restarting the microprocessor in the case where a malfunction occurs; the RAM memory 122 that is always supplied with electric power from the on-vehicle battery 101 and a partial region of which is utilized as a keep memory for maintaining the storage state even in the case where the power switch 103 is opened; and the nonvolatile data memory 124A in which, during a delayed power-supply period after the power switch 103 is opened, important data that has been stored in a specific region of the RAM memory 122 and transferred thereto is stored. The program memory 121A further incorporates a control program including the activation inspection means 226 or the restart inspection means 216 that is selected by the initialization determination means 202 and the initialization means 208 or 218 for performing writing setting of a predetermined default value for the RAM memory 122 that are implemented in that order. The initialization determination means 202 is a means for determining whether the activation inspection means 226, which is performed when the engine is activated, is to be performed or the restart inspection means 216, which is performed when a malfunction occurs in the microprocessor 120A while the engine is running, is to be performed.

The activation inspection means 226 is configured with a plurality of means in the self-diagnosis means, i.e., the transfer inspection means 203 for transferring the content of the data memory 124A to the RAM memory 122 and detecting whether or not any bit information has intruded in the transferred data and whether or not any bit information in the transferred data has been lost; the code inspection means 206 for detecting whether or not any bit information has intruded in the program memory 121A and whether or not any bit information in the program memory 121A has been lost; the reading/writing inspection means 205 for inspecting whether or not reading from and writing in the RAM memory 122 are normally performed; and the disconnection inspection means 204 for inspecting the power-supply circuit for the air-intake-valve driving actuator 106*a*.

The restart inspection means 216 is a memory inspection means that includes at least one of the code inspection means 213 for detecting whether or not any bit information has intruded in the program memory 121A and whether or not any bit information in the program memory 121A has been lost and the reading/writing inspection means 215 for inspecting whether or not reading from and writing in the RAM memory 122 are normally performed, and that is configured with self-diagnosis items simplified compared with the activation inspection means 226. The foregoing self-diagnosis means further includes the periodic code inspection means 310 and 320 that are approximately periodically performed during the operation of the microprocessor 120A, with regard to respective partial regions of the program memory 121A and the RAM memory 122, that resets the microprocessor 120A so as to perform the initialization and the restart thereof when it detects the occurrence of intrusion or loss of bit information, and that sets a malfunction occurrence flag for the malfunction in the program memory 121A or in the RAM memory 122; The memory inspection means performed in the restart inspection means 216 is to make inspection of the memory corresponding to the kind of the foregoing malfunction occurrence flag.

The program memory 121A further incorporates the valve opening level control means 306*d* for the air-intake-valve driving actuator 106*a* and a control program corresponding to the limp-home drive means 222 for driving and controlling the engine while the valve opening level control means 306*d* is halted; the external diagnosis circuits 130A and 134A and the malfunction storage/determination circuit 136 are added to the microprocessor 120A. The external diagnosis circuit is formed of at least one of the watchdog timer 134A that, when the period of the watchdog signal WD1 that is generated by the microprocessor 120A exceeds a predetermined threshold value, generates the reset output RST so as to initialize and restart the microprocessor 120A and the monitoring/controlling circuit 130A that monitors the controlling operation of the microprocessor 120A and when a malfunction is detected, generates the main-portion-malfunction detection signal ER3 so as to initialize and restart the microprocessor 120A.

The malfunction storage/determination circuit 136 is a counter circuit that counts an occurrence number of the reset signal RS1 inputted from the external diagnosis circuits 130A and 134A to the microprocessor 120A and an occurrence number of the self-checked-malfunction detection signal ER1 generated by the self-diagnosis means and when the counted number exceeds a predetermined value, interrupts the electric power for the air-intake-valve driving actuator 106*a* so as to make the limp-home drive means 222 effective. The counted present value of the counter circuit is reset by the initial pulse IP generated when the power switch 103 is turned on; the microprocessor 120A is activated by being initialized by the initial pulse IP.

In the vehicle-mounted engine control apparatus, according to Embodiment 1 of the present invention, configured as described above, the microprocessor is always inspected, with regard to a malfunction, not only by periodic code inspection means but also by the external diagnosis circuit, while the engine is running; when the cause of the occurrence of a malfunction is accidental one, e.g., erroneous operation due to noise, the microprocessor is rapidly initialized and restarted so as to continue the drive, and when the number of occurrences of malfunctions exceeds a predetermined value, the limp-home drive is performed in which the opening level of the air-intake valve is fixed to a default level. Accordingly, the vehicle-mounted engine control apparatus is characterized in that, because the malfunction inspection is shared by the self-diagnosis and the external diagnosis, the restart inspection time is shortened, and when the cause of the occurrence of a malfunction is accidental one, e.g., erroneous operation due to noise and the malfunction is recoverable, the engine interruption time is shortened so that the engine can rapidly move to the continuous drive state.

In addition, in Embodiment 1, the program memory 121A further incorporates a control program corresponding to the asynchronous fuel injection control means. The asynchronous fuel injection control means is to shorten the time period between the preliminary stage in which the initialization by at least the restart inspection is completed, the cylinder discrimination based on the crank angle sensor is completed, and then the fuel injection control 306*b*, which is in conjunction with and in synchronization with the operation of the crank angle sensor, is sequentially performed for each of the cylinders and the stage in which the preliminary concurrent injection is performed for a plurality of cylinders, the microprocessor 120A is reset, and then the engine is driven again. With regard to the asynchronous fuel injection control means, at least one of the first asynchronous fuel injection control means 406 for performing at once the concurrent injection for every cylinder, in conjunction with the operations of the crank angle sensors 107*a* and 107*b*, and the second asynchronous fuel injection control means 408 for performing at once the concurrent group injection only for a cylinder group that incorporates a cylinder for which the fuel is required to be injected, after the discrimination of the cylinder group, which is configured with cylinders among which the injection timings differ by at least two strokes, is performed.

As described above, in the vehicle-mounted engine control apparatus according to Embodiment 1, after the initialization by the restart inspection, the preliminary injection is performed at once, for each of the cylinders or by the cylinder group, by the first asynchronous fuel injection control means or the second asynchronous fuel injection control means. Accordingly, the vehicle-mounted engine control apparatus according to Embodiment 1 is characterized in that the time period of the engine-drive interruption, which is caused by the microprocessor being reset due to erroneous operation, during driving of the vehicle, caused by noise, can further be shortened. In addition, the asynchronous fuel injection control means for improving the startability of an engine is to be utilized when the engine rotation speed is low, the ambient temperature is low, and the voltage of the on-vehicle battery is low; however, the asynchronous fuel injection control means performed after the restart inspection is to be utilized so as to shorten the time period between the moment when the engine is instantaneously interrupted and the moment when the initial combustion is carried out again, even when the engine rotation speed is high, and the ambient temperature and the voltage of the on-vehicle battery are appropriate. Additionally, the vehicle-mounted engine control apparatus according to Embodiment 1 is characterized in that, although temporarily deteriorating the conditions of exhaust gas, the first asynchronous fuel injection control means enables the engine to be restarted as rapidly as possible, and although temporarily deteriorating the conditions of exhaust gas, the second asynchronous fuel injection control means enables the engine to be restarted in a relatively short time.

In the vehicle-mounted engine control apparatus according to Embodiment 1, the initialization determination means 202 is determined through the logic state of an initial flag FLG; the initial flag FLG is set by the flag setting means 209 when the activation inspection means 226 is performed and reset when the power switch 103 is turned on. When the initial flag FLG has not been set, the activation inspection means 226 is performed; when the initial flag FLG has been set, the restart inspection means 216 is performed.

As discussed above, the initialization determination means 202 selects the activation inspection or the restart inspection, based on the operation status of the initial flag that is reset when the power is turned on and set after the activation inspection is performed; thus, in the case where an instantaneous power failure occurs while the engine is running, the initial flag is reset so that the activation inspection is performed. Therefore, the vehicle-mounted engine control apparatus according to Embodiment 1 is characterized in that the initialization determination can be performed by a simple means, and in the case where an instantaneous power failure occurs while the engine is running, the activation inspection can be performed without depending on the periodic code inspection means during driving of the vehicle.

In the periodic code inspection means, the code inspection means 310 for the program memory 121A is divided into a plurality of blocks and then the plurality of blocks is performed; the malfunction occurrence flag related to a malfunction in the program memory includes a plurality of flags corresponding to the respective inspection blocks; in the restart inspection means 216, the code inspection on the block corresponding to the generated malfunction flag is performed.

As described above, the periodic code inspection means for the program memory 121A is divided into a plurality of blocks and then the plurality of blocks is sequentially inspected; therefore, the vehicle-mounted engine control apparatus according to Embodiment 1 is characterized in that the controlling load of the microprocessor during driving of the vehicle can be reduced, and the time period necessary for the restart inspection is reduced, whereby the engine interruption period can be suppressed.

Additionally, in the restart inspection means 216, the memory inspection on the RAM memory 122 is performed when the malfunction occurrence flag related to the RAM memory 122 is activated by the periodic code inspection means 320, and the memory inspections on both the program memory 121A and the RAM memory 122 are performed when the malfunction occurrence flag related to the program memory 121A is activated.

As described above, in the restart inspection performed when abnormality occurs in data read from the program memory 121A, the memory inspection on both the program memory 121A and the RAM memory 122 is performed; therefore, the vehicle-mounted engine control apparatus according to Embodiment 1 is characterized in that, even in the case where the content of the RAM memory 122 is caused to change by the abnormality that occurs in data read from the program memory 121A, it can be prevented that, due to the abnormality in the RAM memory, the microprocessor is reset again.

In the case of the vehicle-mounted engine control apparatus according to Embodiment 1, in the case where the vehicle-mounted engine is a port-injection-type multicylinder engine, the asynchronous fuel injection control means 211*b* performed following the restart inspection means 216 includes the early-injection determination means 404. The early-injection determination means 404 is a means that operates so as to make the first asynchronous fuel injection control means 406 effective, when the memory inspection on the program memory 121A is performed in the restart inspection means 216, and that makes the second asynchronous fuel injection control means 408 effective, in the case where only the memory inspection on the RAM memory 122 is performed in the restart inspection means 216.

As described above, depending on the length of the time required for the restart inspection, the first or the second asynchronous fuel injection control means is separately utilized; therefore, the vehicle-mounted engine control apparatus according to Embodiment 1 is characterized in that, although discomfort due to an engine interruption during driving of the vehicle being suppressed, the concurrent injection for every cylinder is not performed when the inspection time is short, so that the deterioration in the exhaust emission can be suppressed.

In addition, in the case where the vehicle-mounted engine is a port-injection-type multicylinder engine, the vehicle-mounted engine control apparatus according to Embodiment 1 includes the asynchronous injection necessity determination means 210 that operates following the activation inspection means 226. The necessity determination means 210 is a determination means for making the asynchronous fuel injection control means 211*a* effective, when the engine rotation speed is the same as or lower than a predetermined value, the environmental temperature is the same as or lower than a predetermined value, and the voltage of the on-vehicle battery is the same as or lower than a predetermined value. The asynchronous fuel injection control means 211*a* that is performed following the necessity determination means 210 includes the early-injection determination means 404. The early-injection determination means 404 makes the first asynchronous fuel injection control means 406 effective, in the case where the ambient temperature and the voltage of the on-vehicle battery are each the same as or lower than the predetermined value, i.e., they are in inadequate conditions; in the case where the ambient temperature and the voltage of the on-vehicle battery are the same or higher than the predetermined values, i.e., they are in adequate conditions such that they are not necessarily inadequate, the early-injection determination means 404 makes the second asynchronous fuel injection control means 408 effective.

As described above, in the case were the asynchronous fuel injection control means is utilized when the engine is activated, the first or the second asynchronous fuel injection control means is separately utilized depending on the activation environment. Therefore, the vehicle-mounted engine control apparatus according to Embodiment 1 is characterized in that the concurrent injection for every cylinder is not performed when the engine-activation environment is poor but not inadequate, so that the deterioration in the exhaust emission can be suppressed.

In the case where the vehicle-mounted engine is a port-injection-type multicylinder engine, the first asynchronous fuel injection control means is the late control means 406 in which, at the first fuel injection timing after the operation of the cylinder discrimination control is started, the fuel injection for every cylinder is performed.

Alternatively, in the case of Embodiment 2 described later, the first asynchronous fuel injection control means is the early method 1006*a* in which, at the fuel injection timing immediately before the operation of the cylinder discrimination control is started, the fuel injection for every cylinder is performed, and at the first fuel injection timing after the operation of the cylinder discrimination control is started, the fuel injection for every cylinder is interrupted.

As described above, as the timing of the concurrent injection for every cylinder, the early-stage or the late-stage timing, which corresponds to the timing before or after the start of the cylinder discrimination control, respectively, is adopted; therefore, the vehicle-mounted engine control apparatus according to Embodiment 1 is characterized in that the early is performed as much as possible so that the time necessary for secure ignition can be ensured.

In the case of the vehicle-mounted engine control apparatus according to Embodiment 1, in the case where the vehicle-mounted engine is an direct-injection-type multicylinder engine, only the second asynchronous fuel injection control means 408 out of the asynchronous fuel injection control means is performed, and the concurrent injection for every cylinder is not performed. Accordingly, the deterioration in the exhaust emission is suppressed and in the case of the in-cylinder injection, the number of strokes between the fuel injection and the ignition are reduced, compared with the out-cylinder injection; therefore, without performing the injection for every cylinder, the initial combustion equivalent to that in the case of out-cylinder injection is started.

Moreover, in the vehicle-mounted engine control apparatus according to Embodiment 1, the monitoring/controlling circuit 130A is serially connected to the microprocessor 120A and is configured with the volatile buffer memory 132A to which the program memory 121A transfers the control constants and the integrated circuit element LSI including the calculation circuit unit the part 104*b* of the driving-condition detection sensor and the part 105*b* of the engine driving device are connected to the monitoring/controlling circuit 130A; the monitoring/controlling circuit 130A serially communicates with the microprocessor 120A with regard to the input and output signals and generates the inquiry signal intended for the microprocessor 120A; in the case where the answer signal, from the microprocessor 120A, to the inquiry signal does not coincide with correct-solution information that has been preliminarily transferred from the program memory 121A to the buffer memory 132A, the monitoring/controlling circuit 130A generates the main-portion-malfunction detection signal ER3 so as to reset and restart the microprocessor 120A. When a malfunction occurs in its serial communication with the monitoring/controlling circuit 130A, the microprocessor 120A generates the assist-portion-malfunction detection signal ER2, so that the malfunction storage/determination circuit 136 adds and counts the occurrence of the malfunction; furthermore, based on the assist-portion-malfunction detection signal ER2, the monitoring/controlling circuit 130A initializes the buffer memory 132A.

As described above, in the vehicle-mounted engine control apparatus according to Embodiment 1, the microprocessor 120A and the monitoring/controlling circuit 130A monitor each other; the microprocessor 120A is reset when a malfunction is found through external monitoring by the monitoring/controlling circuit 130A, and the buffer memory in the monitoring/controlling circuit 130A is initialized within the monitoring/controlling circuit 130A, based on the assist-portion-malfunction detection signal ER2. Accordingly, the vehicle-mounted engine control apparatus according to Embodiment 1 is characterized in that the microprocessor performs the periodic code inspection while the engine is running and is always monitored externally by the monitoring/controlling circuit, so that the safety is enhanced, and the initialization of the memory is shared, whereby the restart initialization time is shortened. Moreover, in the case where a malfunction is found through the external monitoring by the monitoring/controlling circuit and the microprocessor is reset, no memory is inspected in the restart inspection; therefore, the vehicle-mounted engine control apparatus according to Embodiment 1 is characterized in that the restart initialization time is shortened.

Embodiment 2

Figure 7:
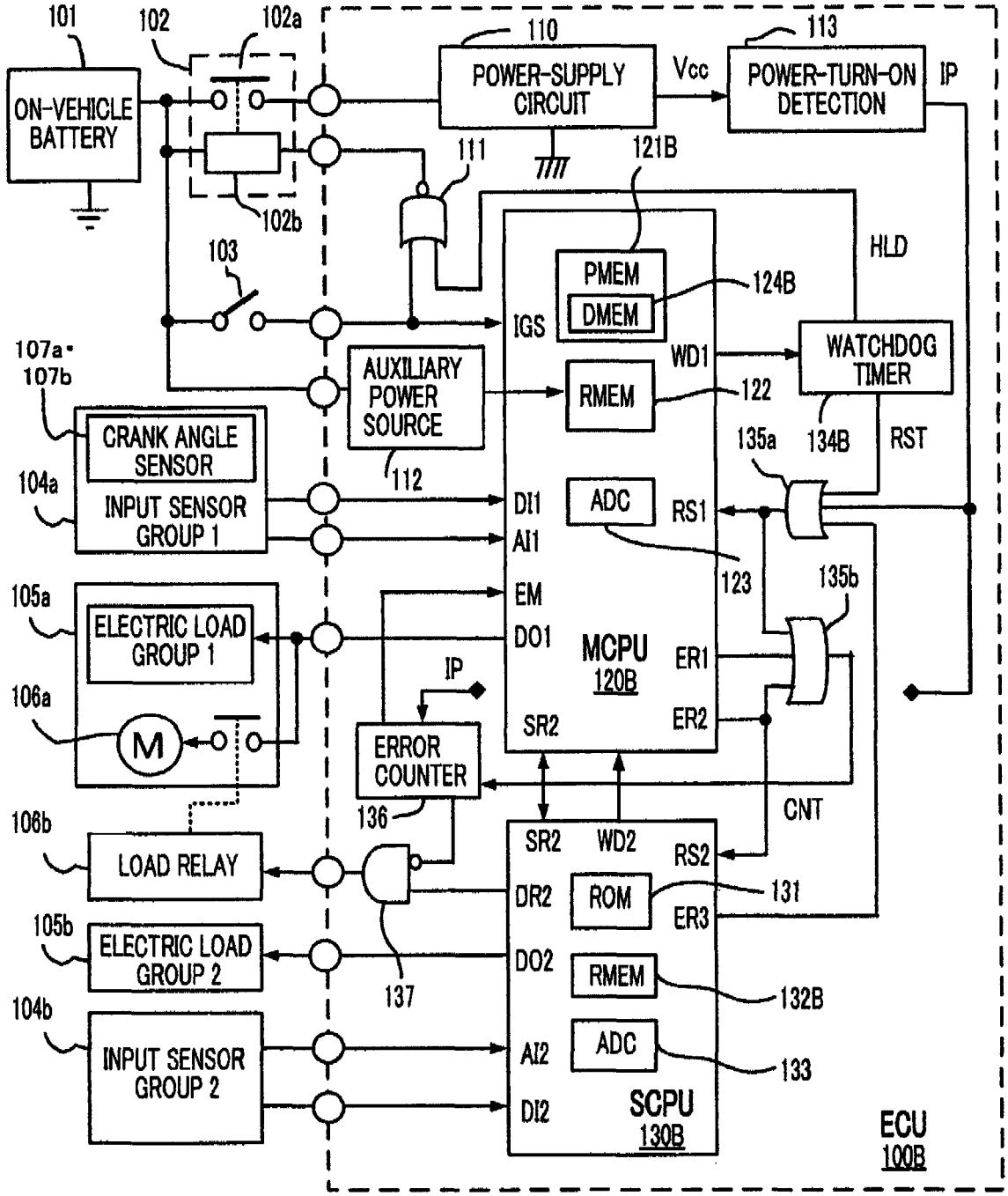
FIG. 7 is a circuit block diagram illustrating the configuration of an vehicle-mounted engine control apparatus according to Embodiment 2 of the present invention.

FIG. 7 is a circuit block diagram illustrating the configuration of an vehicle-mounted engine control apparatus according to Embodiment 2 of the present invention; what differ from FIG. 1 will mainly be explained below. The same reference marks in each of the figures indicate the same or equivalent constituent elements. As is the case with FIG. 1, in FIG. 7, an on-vehicle battery 101 (referred to also as a battery, hereinafter), a power supply relay 102, a power switch 103, driving-condition detection sensors 104*a* and 104*b*, engine driving devices 105*a* and 105*b*, a load-power-source relay 106*b*, and crank angle sensors 107*a* and 107*b* are externally connected to a vehicle-mounted engine control apparatus (ECU) 100B. The vehicle-mounted engine control apparatus 100B is configured mainly with a microprocessor (MCPU) 120B and a monitoring/controlling circuit 130B. A power-supply circuit 110 receives electric power from the battery 101 by way of an output contact 102*a* of the power supply relay 102, generates various kinds of stabilized control power-supply voltages Vcc, and supplies electric power to the microprocessor 120B, the monitoring/controlling circuit 130B, and the peripheral circuits and the input and output interface circuits of the microprocessor 120B and the monitoring/controlling circuit 130B. The drive element 111 is configured in such a way that it energizes an excitation coil 102*b* when the power switch 103 is closed and receives as a logic-sum input a self-hold command signal HLD generated when a watchdog timer 134B operates normally, and when the power switch 103 is once closed, it can stop a watchdog signal WD1 so as to keep the excitation coil 102*b* energized until the self-hold command signal HLD is interrupted. An auxiliary power source 112 is adapted to always receive electric power from the on-vehicle battery 101 and supply electric power to a keep memory as a partial region of a RAM memory 122 so that, even after the power supply relay 102 is de-energized, important data items such as learning/storage data and malfunction-history information data are stored and retained. After the power switch 103 is closed and the power-supply circuit 110 generates the control output voltage Vcc, a power-on detection circuit 113 generates the initial pulse IP so as to initialize and activate the microprocessor 120B and to reset a malfunction storage/determination circuit 136.

The microprocessor 120B incorporates a program memory 121B, such as a nonvolatile flash memory, in which a control program and control constants are written through an unillustrated external tool, the RAM memory 122 for calculation processing, and a multichannel AD converter 123. In addition, the program memory 121B is configured with a main block in which control programs and control constants are written, a first sub-block, and a second sub-block; the blocks are each capable of being erased at once. By alternately utilizing a pair of sub-blocks in the program memory 121B, important data items, such as important learning data that require a long time to learn, the temporal-change characteristics in important sensors, and malfunction-history information, in the keep memory are transferred to and stored in a data memory 124B so that loss of the important data due to abnormal voltage reduction of the battery 101, a power cutoff upon replacement of the battery, or the like is prevented. The monitoring/controlling circuit 130B is an auxiliary microprocessor SCPU that is serially connected by way of a serial port SR2 to the microprocessor 120B and configured with an auxiliary RAM memory 132B to which the program memory 121B transfers the control constants, an auxiliary program memory 131, and a multichannel AD converter 133. When the period of the watchdog signal WD1 that is generated by the microprocessor 120B exceeds a predetermined threshold value, the watchdog timer 134B generates a reset output RST so as to initialize and restart the microprocessor 120B.

A logical-sum element 135*a* makes a logical sum of the reset output RST, an initial pulse IP, and a main-portion-malfunction detection signal ER3 described later and supplies a reset input signal RS1 to the microprocessor 120B; a logical-sum element 135*b* makes a logical sum of the reset signal RS1, a self-checked-malfunction detection signal ER1 described later, and a assist-portion-malfunction detection signal ER2 described later and generates a malfunction count signal CNT for the malfunction storage/determination circuit 136. The malfunction storage/determination circuit 136 is reset by the initial pulse IP when the power is turned on, and then counts an occurrence number of the malfunction count signal CNT; when the count value exceeds a predetermined value, the malfunction storage/determination circuit 136 de-energizes the load-power-source relay 106*b* by the intermediary of a gate element 137 and supplies a limp-home drive command signal EM to the microprocessor 120B. The microprocessor 120B generates a load-power-source power-on command signal DR2 by the intermediary of the serial port SR2 and the monitoring/controlling circuit 130B, and then drives the load-power-source relay 106*b* by the intermediary of the gate element 137. The microprocessor 120B is provided with various diagnosis functions described later; when a malfunction occurs in its control operation, the microprocessor 120B resets itself so as to initialize and restart itself, and generates the self-checked-malfunction detection signal ER1 which is added and counted, as the malfunction count signal CNT for the malfunction storage/determination circuit 136.

The microprocessor 120B also monitors a watchdog signal WD2 generated by the monitoring/controlling circuit 130B as an auxiliary microprocessor and when the pulse width of the watchdog signal WD2 exceeds a predetermined value, generates the assist-portion-malfunction detection signal ER2; the malfunction storage/determination circuit 136 adds and counts the occurrence of a malfunction, and after receiving a reset input signal RS2 based on the assist-portion-malfunction detection signal ER2, the monitoring/controlling circuit 130B initializes the auxiliary RAM memory 132B. The part 104*b* of the driving-condition detection sensor and the part 105*b* of the engine driving device are connected to the monitoring/controlling circuit 130B; the monitoring/controlling circuit 130B serially communicates with the microprocessor 120B with regard to the input and output signals and generates the inquiry signal intended for the microprocessor 120B; in the case where an answer signal, from the microprocessor 120B, to the inquiry signal does not coincide with correct-solution information that has been preliminarily transferred from the program memory 121B to the auxiliary RAM memory 132B, the monitoring/controlling circuit 130B generates the main-portion-malfunction detection signal ER3 so as to reset and restart the microprocessor 120B.

Figure 8:
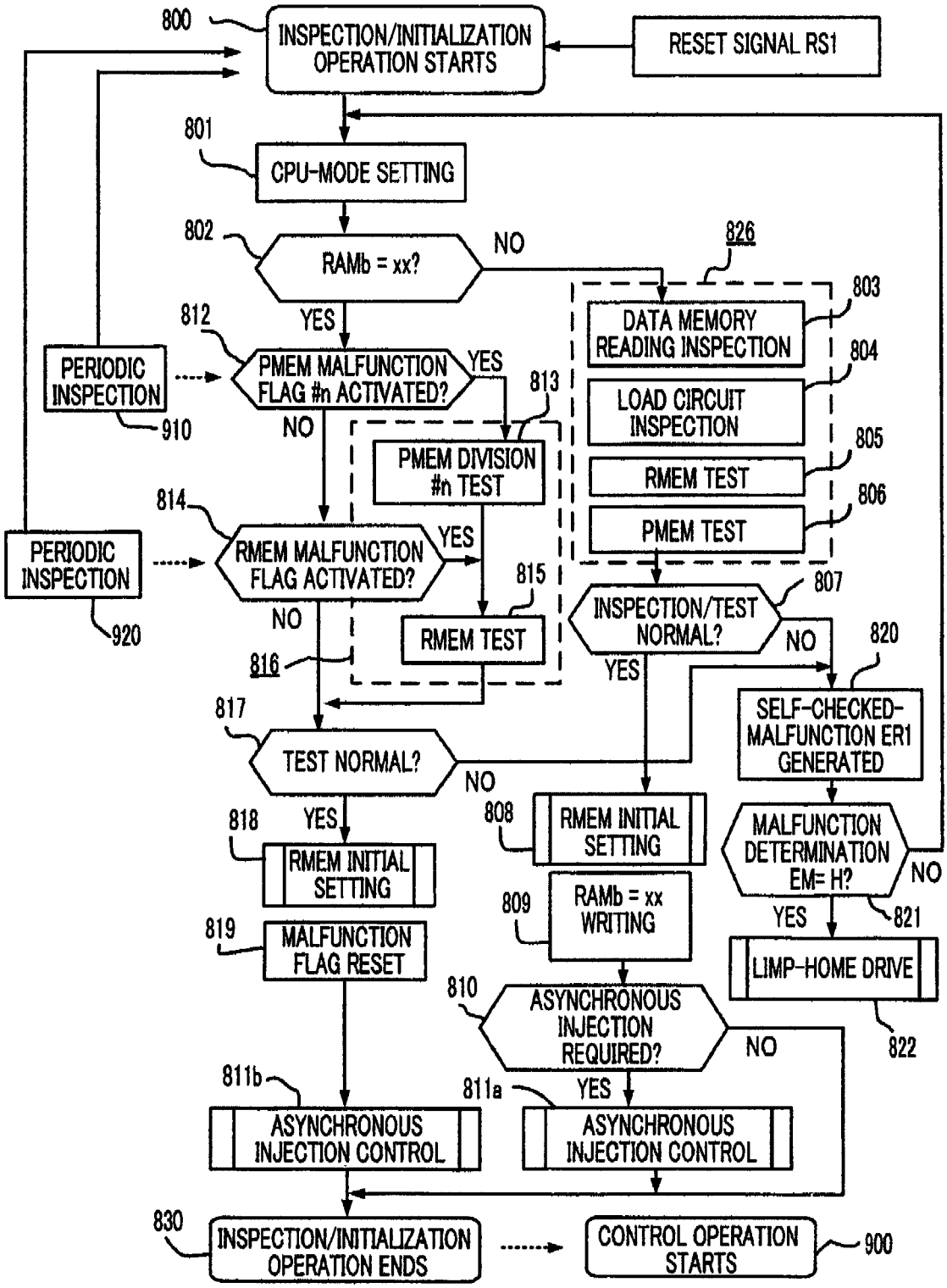
FIG. 8 is a flowchart for explaining the operation of initializing a microprocessor in FIG. 7.
Figure 9:
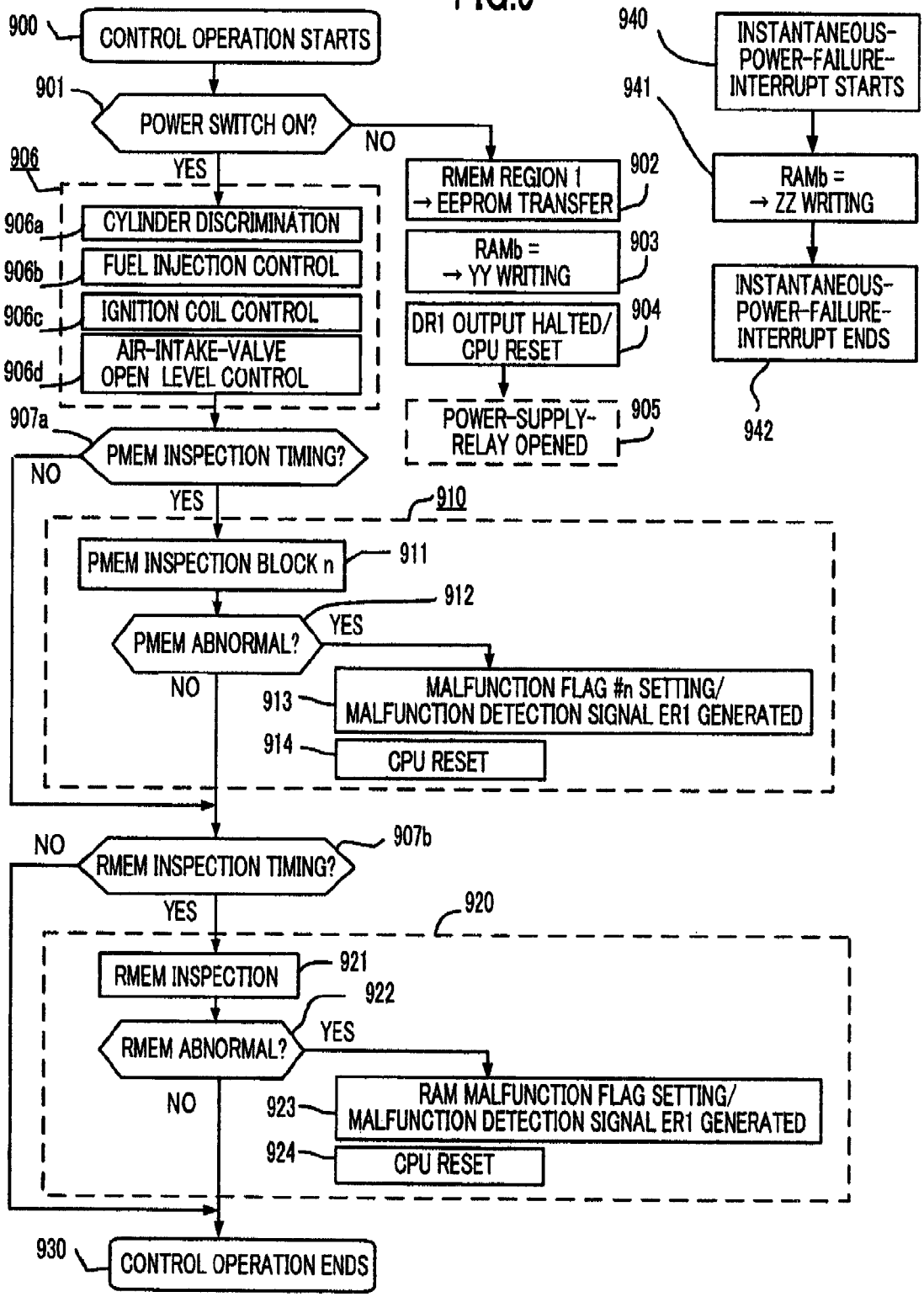
FIG. 9 is a flowchart for explaining the operation of a microprocessor in FIG. 7 while the engine is running.

With regard to the vehicle-mounted engine control apparatus, according to Embodiment 2, configured as described above, in the first place, the outline of the operation of the circuitry in FIG. 7 will be explained. In FIG. 7, when the power switch 103 is closed, the excitation coil 102*b* is energized through a drive element 111, and an output contact 102*a* of the power supply relay 102 is closed, so that a power-source-terminal voltage Vin from the battery 101 is applied to the power-supply circuit 110. The power-supply circuit 110 generates the various stabilized control power-supply voltages Vcc and supplies the control power-supply voltages Vcc to the units in the vehicle-mounted engine control apparatus 100B; the power-on detection circuit 113 generates the initial pulse IP so as to reset the present count value in the malfunction storage/determination circuit 136, and supplies the reset input signal RS1 to the CPU 120B by the intermediary of the logical-sum element 135*a*. As a result, the initialization operation illustrated in FIG. 8 is started; when the CPU 120B is normally activated, the controlling operation illustrated in FIG. 9 is performed, so that the engine driving devices 105*a* and 105*b* are driven and controlled, in accordance with the operation statuses of the driving-condition detection sensors 104*a* and 104*b* and with an input/output control program stored in the program memory 121B. The microprocessor 120B performs a malfunction inspection on its own inside through a self-diagnosis function described later; when a malfunction occurs, the CPU 120B resets itself so as to perform the initialization operation illustrated in FIG. 8, thereby restarting itself, and generates the self-checked-malfunction detection signal ER1, so that the malfunction storage/determination circuit 136 counts the occurrence of the malfunction.

The watchdog timer 134B monitors the pulse width of the watchdog signal WD1 generated by the microprocessor 120B; when the pulse width exceeds a predetermined value, the watchdog timer 134B generates the reset output RST so as to reset the microprocessor 120B, the initialization operation illustrated in FIG. 8 is performed, the microprocessor 120B is restarted, and then the malfunction storage/determination circuit 136 counts the occurrence of the malfunction. The monitoring/controlling circuit 130B monitors the status of control by the microprocessor 120B; when the answer from the microprocessor 120B is abnormal, the monitoring/controlling circuit 130B generates the main-portion-malfunction detection signal ER3 so as to reset the microprocessor 120B, the initialization operation illustrated in FIG. 8 is performed, the microprocessor 120B is restarted, and then the malfunction storage/determination circuit 136 counts the occurrence of the malfunction. When the watchdog signal WD2 from the monitoring/controlling circuit 130B is abnormal, the microprocessor 120B generates the assist-portion-malfunction detection signal ER2, the monitoring/controlling circuit 130B initializes the auxiliary RAM memory 132B, and then the malfunction storage/determination circuit 136 counts the occurrence of the malfunction. When the count value stored in the malfunction storage/determination circuit 136 exceeds a predetermined value, the gate element 137 de-energizes the load-power-source relay 106*b* so as to return an air-intake-valve driving actuator 106*a* to its initial position, and the limp-home drive command signal EM is inputted to the microprocessor 120B, so that the limp-home drive control is performed at the fixed throttle valve opening level.

Next, FIG. 8, which is a flowchart for explaining the initialization operation of the microprocessor 120B illustrated in FIG. 7, will be explained. In FIG. 8, a series of control flow from the process 800 to the process 830 is the same as a series of control flow from the process 200 to the process 230 in FIG. 2, except for the process 802 and the process 809. The process 802 is a step, corresponding to an initialization determination means, in which whether an activation inspection means 826 is performed or a restart inspection means 816 is performed is selected; upon the first operation after the power is turned on, "NO" determination is made, the process 802 is followed by the process 803, and activation completion storage is carried out in the process 809, so that, from the next initialization determination onward, "YES" determination is made and the process 802 is followed by the process 812. In the process 809, a first specific numerical value XX is written in a determination memory RAMb located in a specific address of a second region as the keep memory region of the RAM memory 122. In the process 802, when the content of the determination memory RAMb coincides with the first specific numerical value XX, it is considered that an inspection in the activation inspection means 826 has been completed and "YES" determination is made.

Next, FIG. 9, which is a flowchart for explaining the operation, of the microprocessor 120B illustrated in FIG. 7, while the engine is running will be explained. In FIG. 9, a series of control flow from the process 900 to the process 930 is the same as a series of control flow from the process 300 to the process 330 in FIG. 3, except for the process 903. In the process 903, a second specific numerical value YY is written in the determination memory RAMb in which the first specific numerical value XX has been written in the process 809. Accordingly, when the power switch 103 is closed again and the diving is resumed, "NO" determination is made in the process 802, and then an inspection by the activation inspection means 826 is performed. In addition, in the case where, while the vehicle is parked, the battery 101 abnormally discharges or the battery terminal is removed, the content of the determination memory RAMb becomes unspecified; when the content of the determination memory RAMb is a value other than the second specific numerical value YY, a situation in which the battery replacement is required or the like can be presumed.

The process 940 is an interrupt start step that is caused to operate by an interrupt signal of top priority being inputted to the microprocessor 120B when the power switch 103 is closed and the terminal voltage Vin of the power source abnormally decreases. The process 941 is a step, corresponding to an instantaneous-power-failure processing means, in which the second specific numerical value YY or a third specific numerical value ZZ, other than the first specific numerical value XX, is written in the determination memory RAMb. The process 942 is an interrupt-operation end step. After, due to the instantaneous power failure, the power-on detection circuit 113 generates the initial pulse IP and the microprocessor 120B is reset, "NO" determination is made in the process 802 in the initialization operation in FIG. 8, and then the inspection by the activation inspection means 826 is performed. In particular, by, in the process 941, writing the third specific numerical value ZZ in the determination memory RAMb, the occurrence of an instantaneous power failure is detected and that detection can be utilized in other control operations.

Next, FIG. 10, which is a flowchart for explaining the operation of asynchronous fuel injection control according to Embodiment 2, will be explained. In FIG. 10, the process 1000 is a step in which the operation of each of the asynchronous fuel injection control means illustrated as the process blocks 811*a* and 811*b* in FIG. 8 starts. The process 1001 is a determination step in which it is determined whether or not the crank angle sensor 107*a*, out of the crank angle sensors 107*a* and 107*b*, which is provided on the crankshaft has passed the position of a reference point; in the case where the crank angle sensor 107*a* has passed the reference-point position, the process 1001 is followed by the process 1004*a*. As far as the reference point is concerned, the crank angle sensor 107*a* facing a rotating disk, provided on the crankshaft and having teeth in steps of 10 degrees on the circumferential surface thereof, detects a missing-tooth portion provided in the rotating disk, so that the passage of the reference point is detected. The process 1004 is a step, corresponding to an early-injection determination means, in which it is determined whether or not an emergency injection is required, and in the case where an emergency injection is required, "YES" determination is made and the process 1004*a* is followed by the process 1006*a*, but in the case where no emergency injection is required, "NO" determination is made and the process 1004*a* is followed by the process 1002.

In addition, in the early-injection determination means 1004*a* in the asynchronous fuel injection control means 811*b* performed following the restart inspection means 816, it is determined that the emergency injection is required, in the case where memory inspection on the program memory 121B is performed in the restart inspection means 816; it is determined that no emergency injection is required, in the case where only the memory inspection on the RAM memory 122 is performed in the restart inspection means 816. Additionally, in the early-injection determination means 1004*a* in the asynchronous fuel injection control means 811*a* performed following the restart inspection means 826, it is determined that the emergency injection is required, in the case where the ambient temperature and the voltage of the on-vehicle battery are the same or lower than predetermined values, i.e., they are inadequate conditions; in the case where the ambient temperature and the voltage of the on-vehicle battery are the same or higher than the predetermined values, i.e., they are in adequate conditions such that they are not necessarily inadequate conditions, it is determined that no emergency injection is required.

The process block 1002 corresponds to a cylinder discrimination means by which, while the processes 1003, 1004*b*, and 1005 described later are circularly passed, the operation statuses of the crank angle sensor 107*a* that responds to the rotation of the crankshaft and the crank angle sensor 107*b* that responds to the rotation of the air-intake-valve camshaft are monitored so that the cylinder groups are discriminated from one another and discrimination control for deciding the fuel injection timing and the ignition timing for each cylinder is performed. In addition, the cylinder discrimination means

1002 completes the discrimination among all the cylinders in a time period from the moment when the cylinder discrimination stars to the moment when the engine has rotated maximally twice; however, the discrimination among the cylinder groups is completed earlier than the discrimination among all the cylinders is completed.

The process 1003 is a determination step in which whether or not the discrimination among the cylinder groups has been completed in the process block 1002; in the case where the discrimination has not been made, "NO" determination is made and the process 1003 is followed by the process 1004*b*; in the case where the discrimination has been made, "YES" determination is made and the process 1003 is followed by the process 1007. The process 1004*b* is a step, corresponding to an early-injection determination means, in which it is determined whether or not an emergency injection is required, and in the case where an emergency injection is required, "YES" determination is made and the process 1004*b* is followed by the process 1006*b*, but in the case where no emergency injection is required, "NO" determination is made and the process 1004*b* is followed by the process 1005. The process 1005 is a determination step in which whether or not either one of the crank angle sensors 107*a* and 107*b* has operated; in the case where neither one of the crank angle sensors 107*a* and 107*b* has operated, "NO" determination is made and the process 1005 is resumed; in the case where either one of the crank angle sensors 107*a* and 107*b* has operated, "YES" determination is made and the process 1005 is circularly followed by the process 1002. The process 1006*a* is a step, corresponding to a first asynchronous fuel injection control means (an early), in which a first asynchronous injection, described later with reference to FIG. 11(C), is performed. The process 1006*b* is a step in which a late in the first asynchronous fuel injection control means for performing the first asynchronous injection, described later with reference to FIG. 11(C), is stopped.

The process 1007 is a determination step in which it is determined whether or not the discrimination among all the cylinders has been completed in the process block 1002; in the case where the discrimination has not been made, "NO" determination is made and the process 1007 is followed by the process 1008; in the case where the discrimination has been made, "YES" determination is made and the process 1007 is followed by the process 1010. The process 1008 is a step, corresponding to a second asynchronous fuel injection control means, in which a second asynchronous injection, described later with reference to FIG. 11(B), is performed. The process 1006*a*, 1006*b*, or 1008 is followed by the operation end process 1010, and then the operation end process 830 in FIG. 8 and the operation start process 900 in FIG. 9 are passed through, so that the synchronous injection, illustrated as the fuel injection control means 906*b*, is performed.

Next, FIG. 11, which is an operation stroke chart in the case where, in the vehicle-mounted engine control apparatus in FIG. 7, an out-cylinder-injection engine is utilized will be explained. FIG. 11(A), which is entirely the same as FIG. 5(A), is a chart representing a fuel injection timing I and an ignition timing IG in the case where a normal synchronous injection is performed. FIG. 11(B), which is entirely the same as FIG. 5(B), is a chart representing a case where a cylinder-group concurrent injection is performed by the second asynchronous fuel injection control means 1008. FIG. 11(C) is a chart representing a case where concurrent injection for all the cylinders is performed by the first asynchronous fuel injection control means 1006*a*; the fuel injection 50*c* is performed in the exhaust stroke of the cylinder 3, and at the same time, the asynchronous concurrent injection 50*a* is performed in the air-intake stroke of the cylinder 1; furthermore, at the same time, the fuel injection 50*b* is performed in the compression stroke of the cylinder 2, and the fuel injection 50*d* is performed in the combustion stroke of the cylinder 4. However, at this timing, the respective present strokes of the cylinders are by no means discriminated; the cylinder 3 is accidentally in the exhaust stroke. As a result, initial combustion 53 occurs based on the fuel injection 50*c* of the cylinder 3; thus, the initial combustion occurs further one stroke earlier than the initial combustion in FIG. 11(B). However, in the cylinder 1, based on two fuel injections, i.e., the concurrent fuel injection 50*a* and the fuel injection 53*a* in the exhaust stroke, combustion occurs in the combustion stroke 56, and in the cylinder 2, based on two fuel injections, i.e., the concurrent fuel injection 50*b* and the fuel injection 52*b* in the exhaust stroke, combustion occurs in the combustion stroke 55; therefore, it is required to allow the excess fuel to further increase the amount of poisonous exhaust gases.

Comparing FIG. 5(C) with FIG. 11(C), in FIG. 5(C), concurrent injection for all the cylinders is performed at the fuel injection timing immediately after the start of the cylinder discrimination; in FIG. 11(C), however, concurrent injection for all the cylinders is performed at the fuel injection timing immediately before the start of the cylinder discrimination. Accordingly, FIG. 5(C) represents a late-stage concurrent injection method, and in contrast, FIG. 11(C) represents an early-stage concurrent injection method; compared with FIG. 5(C), FIG. 11(C) represents an accurate fuel injection timing for the cylinder 3 as an initial-combustion cylinder; in the case of FIG. 5(C), because the fuel injection timing for the cylinder 3 as an initial-combustion cylinder is the air-intake stroke, which is delayed by one stoke, supply of appropriate fuel cannot be performed. However, in the case of FIG. 11(C), because the fuel injection 50*d* for the cylinder 4 is performed in the combustion stroke, the initial fuel supply for the cylinder 4 cannot appropriately be performed. In the case of the in-cylinder injection engine, the operation stroke chart is entirely the same as FIG. 6.

Figure 12:
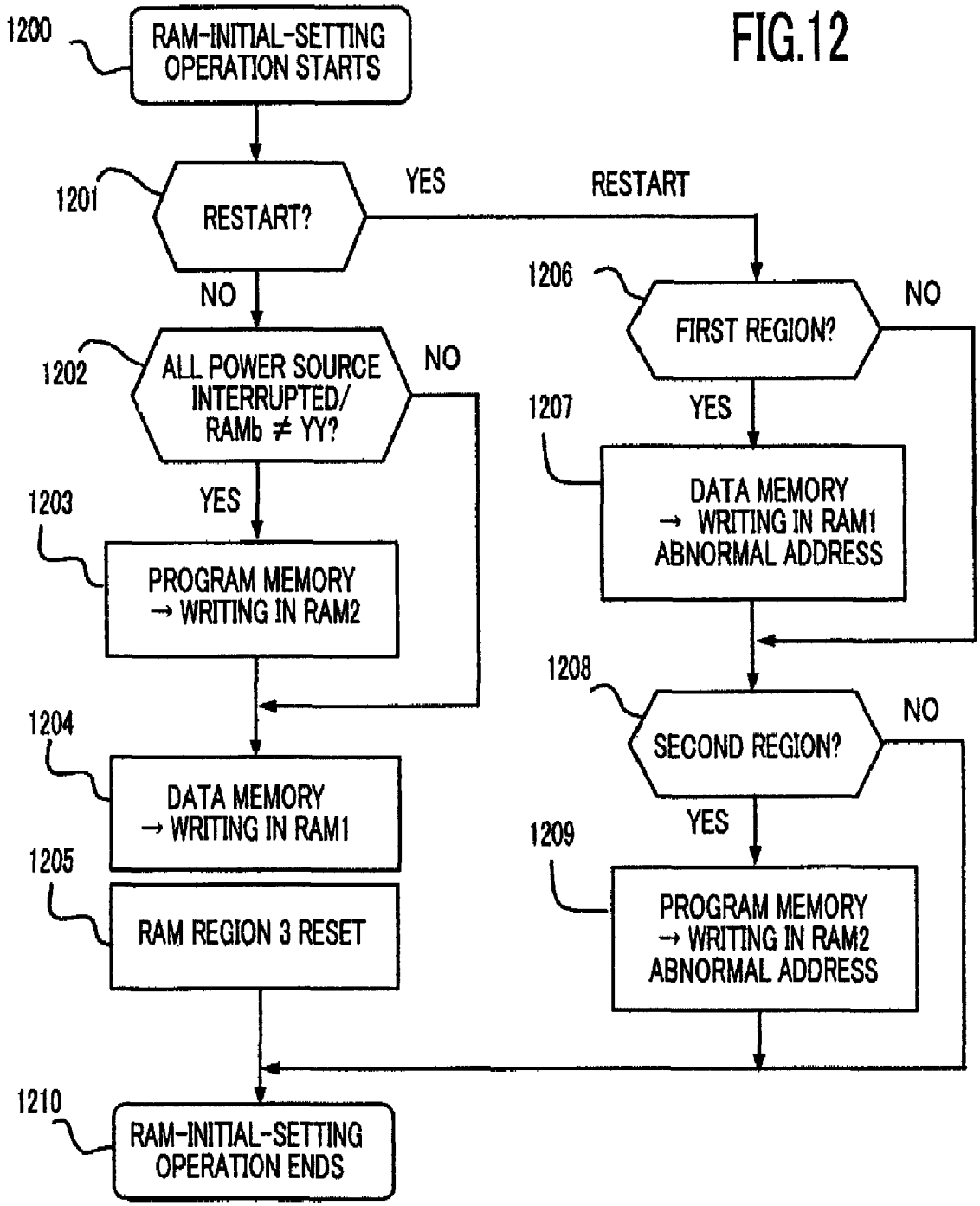
FIG. 12 is a flowchart for explaining the operation of initializing a RAM memory in FIG. 7.

Next, FIG. 12, which is a flowchart for explaining the initialization operation for the RAM memory 122 illustrated in FIG. 7, will be explained. In FIG. 12, the process 1200 is a step in which each of the initial-setting operations, for the RAM memory, illustrated as the process blocks 808 and 818 in FIG. 8 starts. As is the case with the process 802 in FIG. 8, the process 1201 is a step for determining whether or not the content of the determination memory RAMb is the first specific numerical value XX; in the case of restart, "YES" determination is made and the process 1201 is followed by the process 1206; in the case of activation, "NO" determination is made and the process 1201 is followed by the process 1202. The process 1202 is a step for determining whether or not the second specific numerical value YY that has been written in the determination memory RAMb in the process 903 in FIG. 9 is being held; in the case where the power-source terminal of the battery 101 has been disconnected or the voltage of the battery 101 has abnormally dropped, "YES" determination is made and the process 1202 is followed by the process 1203; in the case where the second specific numerical value YY has been stored, "NO" determination is made and the process 1202 is followed by the process 1204. The process 1203 is a step in which the default values for important data, out of control constants that have preliminarily been stored in the program memory 121B, which are to be stored in a second region RAM2 in the RAM memory 122 are concurrently transferred to the RAM memory 122.

The process 1204 is a step in which latest learning data pieces that have been stored in the data memory 124B in the process 902 in FIG. 9 are concurrently transferred to a first region RAM1 in the RAM memory 122. In addition, in the stage prior to the process 902 in which the storage is performed, the default value that has been stored in the program memory 121B when the product has been adjusted for shipment is transferred to the data memory 124B. The process 1205 is a step in which a third region RAM3 in the RAM memory 122 is reset and data, e.g., consisting of a plurality of zeros, is written therein. The process 1206 is a determination step in which it is determined whether or not an abnormality occurrence address, of the RAM memory 122, corresponding to a region where abnormality detected in the process block 920 in FIG. 9 has occurred falls within the addresses for the first region RAM1; in the case where the address falls within the addresses for the first region RAM1, "YES" determination is made and the process 1206 is followed by the process 1207; in contrast, in the case where the address does not fall within the addresses for the first region RAM1, "NO" determination is made and the process 1206 is followed by the process 1208.

The process 1207 is a step in which stored data is transferred from the data memory 124B to the memory corresponding to the abnormality occurrence address. The process 1208 is a determination step in which it is determined whether or not the abnormality occurrence address falls within the addresses for the second region RAM2; in the case where the abnormality occurrence address falls within the addresses for the second region RAM2, "YES" determination is made and the process 1208 is followed by the process 1209; in contrast, in the case where the abnormality occurrence address does not fall within the addresses for the second region RAM2, "NO" determination is made and the process 1208 is followed by the process 1210. The process 1209 is a step in which the default data is transferred from the program memory 121B to the memory corresponding to the abnormality occurrence address. The process 1205 or 1209 is followed by the process 809 or the process block 819 in FIG. 8, by way of the operation end process 1210.

In the foregoing explanation, the process blocks 808 and 818 in FIG. 8 have been described in detail; the process blocks 208 and 218 in FIG. 2 are almost the same as the process blocks 808 and 818. However, in the case of FIG. 2, the process 1201 in FIG. 12 corresponds to the process 202 in FIG. 2, and depending on whether or not the activation completion flag that has been set in the process 209 functions, restart or activation is determined. Additionally, the process 1202 in FIG. 12 is a step in which the content of the RAMa written in the process 303 in FIG. 3 is determined.

Gist and Features of Embodiment 2

As is clear from the foregoing explanation, the vehicle-mounted engine control apparatus 100B according to Embodiment 2 of the present invention includes the microprocessor 120B for controlling the engine driving devices 105*a* and 105*b* in response to the operation statuses of the driving-condition detection sensors 104*a* and 104*b* in a multicylinder vehicle engine; the fuel injection control means 906*b* for collaborating with the microprocessor so as to sequentially open and drive a fuel injection valve, in synchronization with the operation statuses of the crank angle sensors 107*a* and 107*b*; the nonvolatile program memory 121B incorporating self-diagnosis means for initializing and restarting the microprocessor 120B in the case where a malfunction occurs; the RAM memory 122 that is always supplied with electric power from the on-vehicle battery 101 and part of whose region is utilized as a keep memory for maintaining the storage state even in the case where the power switch 103 is opened; and the nonvolatile data memory 124B in which, during a delayed power-supply period after the power switch 103 is opened, important data that has been stored in a specific region of the RAM memory 122 and transferred thereto is stored. The program memory 121B further incorporates a control program including the activation inspection means 826 or the restart inspection means 816 that is selected by the initialization determination means 802 and the initialization mean 808 or 818 for performing writing setting of a predetermined default value for the RAM memory 122 that are implemented in that order. The initialization determination means 802 is a means for determining whether the activation inspection means 826, which is performed when the engine is activated, is to be performed or the restart inspection means 816, which is performed when a malfunction occurs in the microprocessor 120B while the engine is running, is to be performed.

The activation inspection means 826 is configured with a plurality of means, among self-diagnosis means, consisting of the transfer inspection means 803 for transferring the content of the data memory 124B to the RAM memory 122 and detecting whether or not any bit information has intruded in the transferred data and whether or not any bit information in the transferred data has been lost, the code inspection means 806 for detecting whether or not any bit information has intruded in the program memory 121B and whether or not any bit information in the program memory 121B has been lost, the reading/writing inspection means 805 for inspecting whether or not reading from and writing in the RAM memory 122 are normally performed, and the disconnection inspection means 804 for inspecting the power-supply circuit for the air-intake-valve driving actuator 106*a*.

The restart inspection means 816 is a memory inspection means that includes at least one of the code inspection means 813 for detecting whether or not any bit information has intruded in the program memory 121B and whether or not any bit information in the program memory 121B has been lost and the reading/writing inspection means 815 for inspecting whether or not reading from and writing in the RAM memory 122 are normally performed, and that is configured with self-diagnosis items simplified compared with the activation inspection means 826. The foregoing self-diagnosis means further includes the periodic code inspection means 910 and 920 that are approximately periodically performed during the operation of the microprocessor 120B, with regard to partial regions of the program memory 121B and the RAM memory 122, that resets the microprocessor 120B so as to perform the initialization and the restart thereof when it detects the occurrence of intrusion or loss of bit information, and that sets a malfunction occurrence flag for the malfunction in the program memory 121B or in the RAM memory 122. The memory inspection means performed in the restart inspection means 816 is to make inspection of the memory corresponding to the kind of the foregoing malfunction occurrence flag.

The program memory 121B further incorporates the valve opening level control means 906*d* for the air-intake-valve driving actuator 106*a* and a control program corresponding to the limp-home drive means 822 for driving and controlling the engine while the valve opening level control means 906*d* is halted; the external diagnosis circuits 130B and 134B and the malfunction storage/determination circuit 136 are added to the microprocessor 120B. The external diagnosis circuit is formed of at least one of the watchdog timer 134B that, when the period of the watchdog signal WD1 that is generated by the microprocessor 120B exceeds a predetermined threshold value, generates the reset output RST so as to initialize and restart the microprocessor 120B and the monitoring/controlling circuit 130B that monitors the controlling operation of the microprocessor 120B and when a malfunction is detected, generates the main-portion-malfunction detection signal ER3 so as to initialize and restart the microprocessor 120B.

The malfunction storage/determination circuit 136 is a counter circuit that counts an occurrence number of the reset signal RS1 inputted from the external diagnosis circuits 130B and 134B to the microprocessor 120B and an occurrence number of the self-checked-malfunction detection signal ER1 generated by the self-diagnosis means and when the counted number exceeds a predetermined value, interrupts the electric power for the air-intake-valve driving actuator 106*a* so as to make the limp-home drive means 822 effective. The counted present value of the counter circuit is reset by the initial pulse IP generated when the power switch 103 is turned on; the microprocessor 120B is activated by being initialized by the initial pulse IP.

In the initialization determination means, the determination is performed based on the content of the determination memory RAMb; a specific address in the RAM memory 122 is designated to the determination memory; after the activation inspection means 826 is performed, the first specific numerical value XX is written through the determination memory setting means 809; and during a delayed power-supply period after the power switch 103 is opened, the second specific numerical value YY that differs from the first specific numerical value XX is written by the determination memory rewriting means 903. In the case where the content of the determination memory RAMb is a value other than the first specific numerical value XX, the activation inspection means 826 is performed; in the case where the content of the determination memory RAMb coincides with the first specific numerical value XX, the restart inspection means 816 is performed.

In the vehicle-mounted engine control apparatus, according to Embodiment 2 of the present invention, configured as described above, the initialization determination means 802 selects the activation inspection or the restart inspection, based on the content of the determination memory the data in which is rewritten after the activation inspection and immediately before the halt of driving. Accordingly, by a relatively simple means, the initialization determination is performed and the initialization inspection can be selected; the vehicle-mounted engine control apparatus according to Embodiment 2 is characterized in that, due to a change in the content of the selected memory, caused by an abnormal drop of the battery voltage while the vehicle is parked or by replacement of the battery, it can be learn that the content of the keep memory is not reliable.

In addition, in Embodiment 2, the program memory 121B further incorporates a control program corresponding to the instantaneous-power-failure processing means 941; the instantaneous-power-failure processing means 941 is a means that is caused to operate by an interrupt signal of top priority being inputted to the microprocessor 120B when the power switch 103 is closed and the terminal voltage Vin of the power source abnormally decreases, and that writes in the determination memory RAMb the second specific numerical value YY or the third specific numerical value ZZ, other than the first specific numerical value XX.

As discussed above, in the vehicle-mounted engine control apparatus according to Embodiment 2, in the case where, during driving of the vehicle, an instantaneous power failure occurs, the content of the determination memory is rewritten with the second or the third specific numerical value, by use of the instantaneous-power-failure processing means 941. Therefore, the vehicle-mounted engine control apparatus according to Embodiment 2 is characterized in that, in the case where an instantaneous power failure occurs during driving of the vehicle, an activation inspection independent of the periodic code inspection means during the driving can be performed, and in the case where the third specific numerical value is utilized, the occurrence of an instantaneous power failure is detected and the detection can be utilized in other control operations.

Additionally, in the vehicle-mounted engine control apparatus according to Embodiment 2, the monitoring/controlling circuit 130B is formed of the auxiliary microprocessor SCPU serially connected to the microprocessor 120B. The microprocessor 130B as a monitoring/controlling circuit includes the auxiliary program memory 131 and the auxiliary RAM memory 132B that collaborate with the microprocessor 130B; the program memory 121B transfers control constants to the auxiliary RAM memory 132B; the part 104*b* of the driving-condition detection sensor and the part 105*b* of the engine driving device are connected to the monitoring/controlling circuit 130B; the monitoring/controlling circuit 130B performs serial communication with the microprocessor 120B, with regard to input/output signals; the monitoring/controlling circuit 130B generates an inquiry signal intended for the microprocessor 120B, and in the case where an answer signal, from the microprocessor 120B, to the inquiry signal does not coincide with correct-solution information that has been preliminarily transferred from the program memory 121B to the auxiliary RAM memory 132B, the monitoring/controlling circuit 130B generates the main-portion-malfunction detection signal ER3 so as to reset and restart the microprocessor 120B. When the pulse width of the watchdog signal WD2 generated by the auxiliary microprocessor 130B as a monitoring/controlling circuit exceeds a predetermined value, the microprocessor 120B generates the assist-portion-malfunction detection signal ER2, so that the malfunction storage/determination circuit 136 adds and counts the occurrence of a malfunction; at the same time, based on the assist-portion-malfunction detection signal ER2, the auxiliary microprocessor 130B initializes the auxiliary RAM memory 132B.

As described above, in the vehicle-mounted engine control apparatus according to Embodiment 2, the microprocessor 120B and the monitoring/controlling circuit 130B monitor each other; the microprocessor 120B is reset when a malfunction is found through external monitoring by the monitoring/controlling circuit 130B, and the memory in the monitoring/controlling circuit 130B is initialized within the monitoring/controlling circuit 130B, based on the assist-portion-malfunction detection signal ER2. Accordingly, the vehicle-mounted engine control apparatus according to Embodiment 1 is characterized in that the microprocessor performs the periodic code inspection while the engine is running and is always monitored externally by the monitoring/controlling circuit, so that the safety is enhanced, and the initialization of the memory is shared, whereby the restart initialization time is shortened. Moreover, in the case where a malfunction is found through the external monitoring by the monitoring/controlling circuit and the microprocessor is reset, no memory is inspected in the restart inspection; therefore, the vehicle-mounted engine control apparatus according to Embodiment 1 is characterized in that the restart initialization time is shortened.

Various modifications and alterations of this invention will be apparent to those skilled in the art without departing from the scope and spirit of this invention, and it should be understood that this is not limited to the illustrative embodiments set forth herein.

What is claimed is:

1. An vehicle-mounted engine control apparatus comprising:

a microprocessor for controlling an engine driving device, in response to an operation status of a driving-condition detection sensor in a multicylinder vehicle engine;

a fuel injection control means for collaborating with the microprocessor so as to sequentially open and drive a fuel injection valve, in synchronization with an operation status of a crank angle sensor;

a program memory incorporating self-diagnosis means for initializing and restarting the microprocessor in the case where a malfunction occurs;

a RAM memory that is always supplied with electric power from an on-vehicle battery and a partial region of which is utilized as a keep memory for maintaining a storage state even in the case where a power switch is opened; and a data memory in which, during a delayed power-supply period after the power switch is opened, important data that has been stored in a specific region of the RAM memory and transferred thereto is stored, wherein the program memory further incorporates a control program including an activation inspection means or a restart inspection means that is selected by an initialization determination means and followed by an initialization means for performing writing setting of a predetermined default value for the RAM memory;

wherein the initialization determination means is a means for determining whether the activation inspection means, which is performed when an engine is activated, is to be performed or the restart inspection means, which is performed when a malfunction occurs in the microprocessor while the engine is running, is to be performed;

wherein the activation inspection means comprises a plurality of means, among self-diagnosis means, including a transfer inspection means for transferring content of the data memory to the RAM memory and detecting whether or not any bit information has intruded in the transferred data and whether or not any bit information in the transferred data has been lost, a code inspection means for detecting whether or not any bit information has intruded in the program memory and whether or not any bit information in the program memory has been lost, a reading/writing inspection means for inspecting whether or not reading from and writing in the RAM memory are normally performed, and a disconnection inspection means for inspecting a power-supply circuit for an air-intake-valve driving actuator;

wherein the restart inspection means is a memory inspection means that includes at least one of the code inspection means for detecting whether or not any bit information has intruded in the program memory and whether or not any bit information in the program memory has been lost and the reading/writing inspection means for inspecting whether or not reading from and writing in the RAM memory are normally performed, and that is configured with self-diagnosis items that are simplified compared with the activation inspection means;

wherein the self-diagnosis means further include a periodic code inspection means that is approximately periodically performed during the operation of the microprocessor, with regard to partial regions of the program memory and the RAM memory, that resets the microprocessor so as to perform initialization and restart thereof when the occurrence of intrusion or loss of bit information is detected, and that sets a malfunction occurrence flag for a malfunction in the program memory or in the RAM memory; and wherein the memory inspection means performed in the restart inspection means is to make inspection of a memory corresponding to the kind of the malfunction occurrence flag.

2. The vehicle-mounted engine control apparatus according to claim 1, wherein the program memory further incorporates a valve opening level control means for the air-intake-valve driving actuator and a control program corresponding to a limp-home drive means for driving and controlling an engine while the valve opening level control means is halted, and an external diagnosis circuit and a malfunction storage/determination circuit are added to the microprocessor;

wherein the external diagnosis circuit is formed of at least one of a watchdog timer that, when the period of a watchdog signal generated by the microprocessor exceeds a predetermined threshold value, generates a reset output so as to initialize and restart the microprocessor and a monitoring/controlling circuit that monitors controlling operation of the microprocessor and when a malfunction is detected, generates a main-portion-malfunction detection signal so as to initialize and restart the microprocessor;

wherein the malfunction storage/determination circuit is a counter circuit that counts an occurrence number of a reset signal inputted from the external diagnosis circuit to the microprocessor and an occurrence number of a self-checked-malfunction detection signal generated by the self-diagnosis means, and when the counted number exceeds a predetermined value, interrupts the electric power for the air-intake-valve driving actuator so as to make the limp-home drive means effective; and wherein the counted present value of the counter circuit is reset by an initial pulse generated when the power switch is turned on, and the microprocessor is activated by being initialized by the initial pulse.

3. The vehicle-mounted engine control apparatus according to claim 1, wherein the program memory further incorporates a control program corresponding to an asynchronous fuel injection control means;

wherein the asynchronous fuel injection control means is to shorten the time period between the preliminary stage in which initialization by at least the restart inspection means is completed, cylinder discrimination based on the crank angle sensor is completed, and then fuel injection control, which is in conjunction with and in synchronization with the operation of the crank angle sensor, is sequentially performed for each of the cylinders and the stage in which preliminary concurrent injection is performed for a plurality of cylinders, the microprocessor is reset, and then'the engine is driven again; and wherein the asynchronous fuel injection control means utilizes at least one of a first asynchronous fuel injection control means for performing at once concurrent injection for every cylinder, in conjunction with the operations of the crank angle sensor, and a second asynchronous fuel injection control means for performing at once concurrent group injection only for a cylinder group that incorporates a cylinder in which the fuel is required to be injected, after discrimination of the cylinder group, which is configured with cylinders among which injection timings differ by at least two strokes, is performed.

4. The vehicle-mounted engine control apparatus according to claim 1, wherein the initialization determination means is determined based on the logic state of an initial flag; the initial flag is set by a flag setting means after the activation inspection means is performed, and reset when the power switch is turned on; and when the initial flag has not been set, the activation inspection means is performed, but when the initial flag has been set, the restart inspection means is performed.

5. The vehicle-mounted engine control apparatus according to claim 1, wherein the initialization determination means is determined based on the content of a determination memory, wherein a specific address in the RAM memory is designated to the determination memory; after the activation inspection means is performed, a first specific numerical value is written in the determination memory by a determination memory setting means; and during a delayed power-supply period after the power switch is opened, a second specific numerical value other than the first specific numerical value is written in determination memory by a determination memory rewriting means, and wherein, in the case where the content of the determination memory is a value other than the first specific numerical value, the activation inspection means is performed; and in the case where the content of the determination memory coincides with the first specific numerical value, the restart inspection means is performed.

6. The vehicle-mounted engine control apparatus according to claim 5, wherein the program memory further incorporates a control program corresponding to an instantaneous-power-failure processing means; and wherein the instantaneous-power-failure processing means is a means that is caused to operate by an interrupt signal of top priority being inputted to the microprocessor when the power switch is closed and the terminal voltage of the power source abnormally decreases, and that writes in the determination memory the second specific numerical value or a third specific numerical value, other than the first specific numerical value.

7. The vehicle-mounted engine control apparatus according to claim 1, wherein, in the periodic code inspection means, the code inspection means for the program memory is divided into a plurality of blocks and then the plurality of blocks is performed; the malfunction occurrence flag related to a malfunction in the program memory includes a plurality of flags corresponding to the respective inspection blocks; and in the restart inspection means, code inspection on the program memory related to the block corresponding to a generated malfunction flag is performed.

8. The vehicle-mounted engine control apparatus according to claim 1, wherein, in the restart inspection means, memory inspection on the RAM memory is performed when the malfunction occurrence flag related to the RAM memory is activated by the periodic code inspection means, and memory inspections on both the program memory and the RAM memory are performed when the malfunction occurrence flag related to the program memory is activated.

9. The vehicle-mounted engine control apparatus according to claim 3, wherein, in the case where the vehicle-mounted engine is a port-injection-type multicylinder engine, the asynchronous fuel injection control means performed following the restart inspection means includes an early-injection determination means; and the early-injection determination means is a means that operates so as to make the first asynchronous fuel injection control means effective, when memory inspection on the program memory is performed in the restart inspection means, and that makes the second asynchronous fuel injection control means effective, in the case where only memory inspection on the RAM memory is performed in the restart inspection means.

10. The vehicle-mounted engine control apparatus according to claim 3, wherein, in the case where the vehicle-mounted engine is a port-injection-type multicylinder engine, asynchronous injection necessity determination means that operates following the activation inspection means is provided; and the asynchronous injection necessity determination means is a determination means for making the asynchronous fuel injection control means effective, when the engine rotation speed is the same as or lower than a predetermined value, the environmental temperature is the same as or lower than a predetermined value, and the voltage of an on-vehicle battery is the same as or lower than a predetermined value, and wherein the asynchronous fuel injection control means that is performed based on the asynchronous injection necessity determination means includes an early-injection determination means; the early-injection determination means makes the first asynchronous fuel injection control means effective, in the case where the ambient temperature and the voltage of the on-vehicle battery are each the same as or lower than the predetermined value, i.e., in inadequate conditions; and in the case where the ambient temperature and the voltage of the on-vehicle battery are each the same or higher than the predetermined value, i.e., in adequate conditions, the early-injection determination means makes the second asynchronous fuel injection control means effective.

11. The vehicle-mounted engine control apparatus according to claim 3, wherein, in the case where the vehicle-mounted engine is a port-injection-type multicylinder engine, the first asynchronous fuel injection control means is a late control means in which, at the first fuel injection timing after the operation of cylinder discrimination control is started, fuel injection for every cylinder is performed, or an early control means in which, at the fuel injection timing immediately before the operation of the cylinder discrimination control is started, fuel injection for every cylinder is performed, and at the first fuel injection timing after the operation of the cylinder discrimination control is started, the fuel injection for every cylinder is interrupted.

12. The vehicle-mounted engine control apparatus according to claim 3, wherein, in the case where the vehicle-mounted engine is a direct-injection-type multicylinder engine, the asynchronous fuel injection control means utilizes only the second asynchronous fuel injection control means is utilized.

13. The vehicle-mounted engine control apparatus according to claim 2, wherein the monitoring/controlling circuit is serially connected to the microprocessor and is formed of an integrated circuit element including a buffer memory to which the program memory transfers control constants and a calculation circuit unit; and part of a driving-condition detection sensor and part of an engine driving device are connected to the monitoring/controlling circuit, wherein the monitoring/controlling circuit performs serial communication with the microprocessor, with regard to input/output signals, and generates an inquiry signal intended for the microprocessor; and in the case where an answer signal, from the microprocessor, to the inquiry signal does not coincide with correct-solution information that has been preliminarily transferred from the program memory to the buffer memory, the monitoring/controlling circuit generates a main-portion-malfunction detection signal so as to reset and restart the microprocessor, and wherein, when a malfunction occurs in the serial communication with the monitoring/controlling circuit, the microprocessor generates the assist-portion-malfunction detection signal, so that the malfunction storage/determination circuit adds and counts the occurrence of the malfunction; and furthermore, based on the assist-portion-malfunction detection signal, the monitoring/controlling circuit initializes the buffer memory.

14. The vehicle-mounted engine control apparatus according to claim 2, wherein the monitoring/controlling circuit is formed of an auxiliary microprocessor serially connected to the microprocessor; the auxiliary microprocessor includes an auxiliary program memory and an auxiliary RAM memory that collaborate therewith; the program memory transfers control constants to the auxiliary RAM memory; part of a driving-condition detection sensor and part of an engine driving device are connected to the auxiliary microprocessor; the auxiliary microprocessor serially communicates with the microprocessor with regard to input and output signals and generates an inquiry signal intended for the microprocessor, and in the case where an answer signal, from the microprocessor, to the inquiry signal does not coincide with correct-solution information that has been preliminarily transferred from the program memory to the auxiliary RAM memory, the auxiliary microprocessor generates a main-portion-malfunction detection signal so as to reset and restart the microprocessor, and wherein, when the pulse width of a watchdog signal generated by the auxiliary microprocessor exceeds a predetermined value, the microprocessor generates a assist-portion-malfunction detection signal, so that the malfunction storage/determination circuit adds and counts the occurrence of a malfunction; and at the same time, based on the assist-portion-malfunction detection signal, the auxiliary microprocessor initializes the auxiliary RAM memory.

* * * * *